US005605483A

United States Patent [19]

Takeda et al.

[11] Patent Number: 5,605,483

[45] Date of Patent: Feb. 25, 1997

[54] ELECTRON SOURCE AND PRODUCTION THEREOF, AND IMAGE-FORMING APPARATUS AND PRODUCTION THEREOF

[75] Inventors: Toshihiko Takeda; Ichiro Nomura, both of Atsugi; Hidetoshi Suzuki, Fujisawa; Yoshikazu Banno, Ebina; Tetsuya Kaneko, Yokohama, all of Japan

[73] Assignee: Canon Kabushiki Kaisha, Tokyo, Japan

[21] Appl. No.: 451,766

[22] Filed: May 26, 1995

Related U.S. Application Data

[62] Division of Ser. No. 165,845, Dec. 14, 1993.

[51] Int. Cl.[6] ..... H01J 1/30; H01J 9/42; H01J 9/50

[52] U.S. Cl. ..... 445/2; 445/3; 445/51

[58] Field of Search ..... 445/2, 3, 51, 24

[56] References Cited

U.S. PATENT DOCUMENTS

| | | | |
|---|---|---|---|
| 4,954,744 | 9/1990 | Suzuki et al. | 313/336 |
| 4,956,578 | 9/1990 | Shimizu et al. | 315/3 |
| 5,023,110 | 6/1991 | Nomura et al. | 427/49 |
| 5,066,883 | 11/1991 | Yoshioka et al. | 313/309 |

FOREIGN PATENT DOCUMENTS

| | | | |
|---|---|---|---|
| 604939 | 7/1994 | European Pat. Off. . | |
| 6-231678 | 8/1994 | Japan | 445/51 |

OTHER PUBLICATIONS

M. Gilmore et al., "Measurement of Gated Field Emitter Failures," *Rev. Sci. Instrum.* 64(2) Feb. 1993, pp. 581–582.

*Primary Examiner*—P. Austin Bradley
*Assistant Examiner*—Jeffrey T. Knapp
*Attorney, Agent, or Firm*—Fitzpatrick, Cella, Harper & Scinto

[57] ABSTRACT

An electron source is constituted of a substrate, and an electron-emitting element provided on the substrate. The electron-emitting element comprises a plurality of electrode pairs having an electroconductive film between each of the electrode pairs. An electron-emitting region is formed on the electroconductive film of selected ones of the electrode pairs. A method of testing the electrode pairs and/or the thin film for a defect and then generating an electron-emitting region so as to have no defect is available.

8 Claims, 20 Drawing Sheets

FIG. 16A(1)
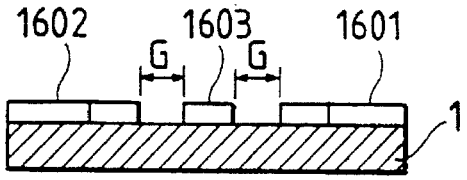
FIG. 16A(2)
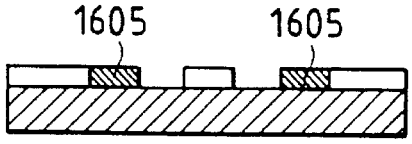
FIG. 16A(3)
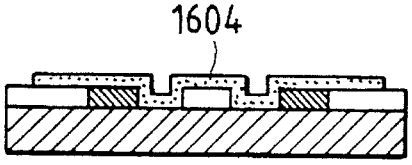
FIG. 16A(4)
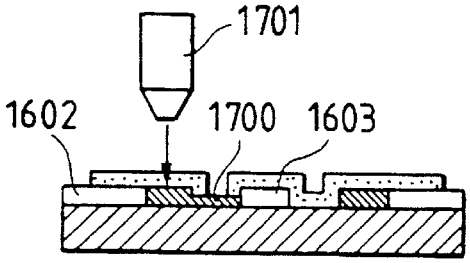
FIG. 16A(5)
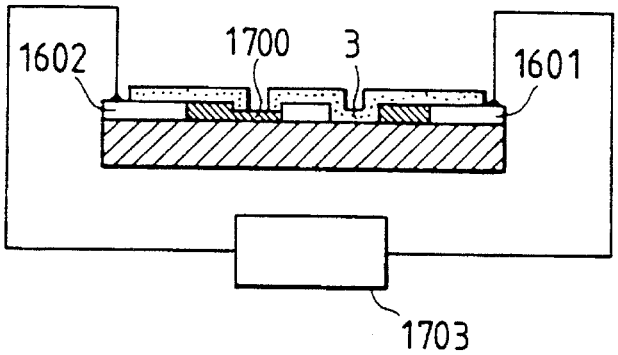
FIG. 16A(6)
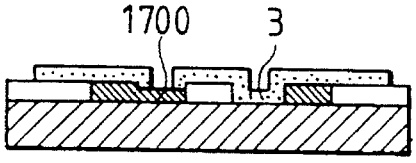

FIG. 16B(4')
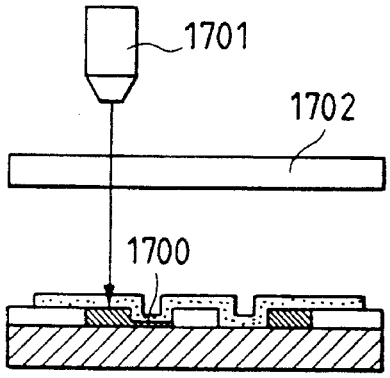
FIG. 16B(4")
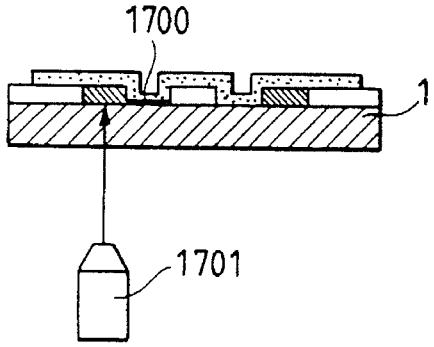
FIG. 17
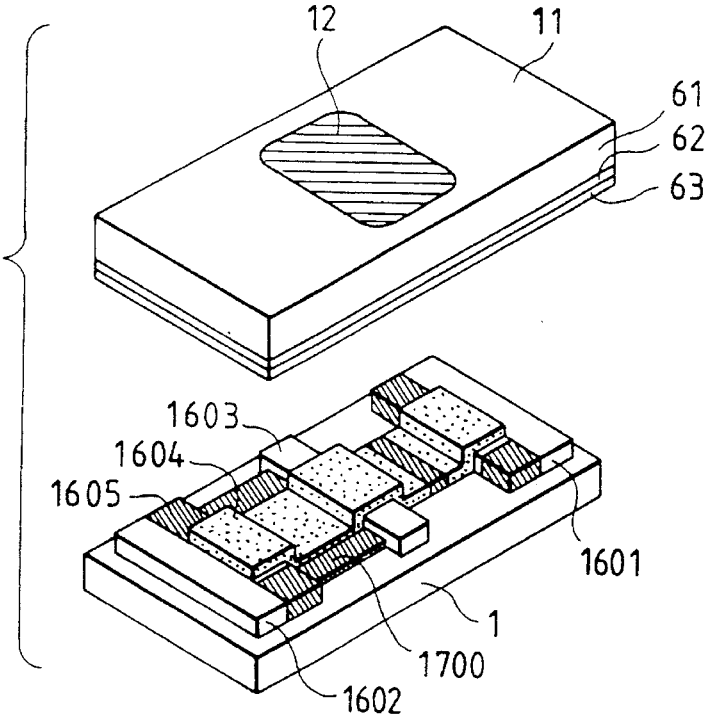

ELECTRON SOURCE AND PRODUCTION THEREOF, AND IMAGE-FORMING APPARATUS AND PRODUCTION THEREOF

This application is a division of application Ser. No. 08/165,845 filed Dec. 14, 1993.

BACKGROUND OF THE INVENTION

1. Field of the Invention

The present invention relates to an electron source for emitting an electron beam and a process for producing the electron source. The present invention also relates to an image-forming apparatus such as an image-displaying apparatus for forming an image on irradiation of an electron beam.

2. Related Background Art

Two kinds of electron-emitting elements are known: thermoelectron sources and cold cathode electron sources. The cold cathode electron sources include field emission type electron sources (hereinafter referred to as "FE"), metal/insulator/metal type electron sources (hereinafter referred to as "MIM"), surface conduction electron-emitting elements, and the like.

The above FE is exemplified by the ones disclosed by W.P. Dyke & W.W. Dolan ("Field emission": Advance in Electron Physics, 8, 89, (1956)), C.A. Spindt ("Physical Properties of Thin-Film Field Emission Cathodes with Molybdenum Cones": J. Appl. Phys, 47, 5248, (1976)), etc.

The above MIM is exemplified by the ones disclosed by C.A. Mead ("The Tunnel-Emission Amplifier": J. Appl. Phys., 32, 646 (1961), etc.

The above surface conduction electron emitting element is exemplified by the ones disclosed by M.I. Elinson (Radio Eng. Electron Phys. 10, (1965)), etc.

The surface conduction electron-emitting element utilizes the phenomenon that electrons are emitted by flowing an electric current through a thin film formed with a small area on a substrate and in parallel to the surface of the film. Such surface conduction electron-emitting elements include, in addition to the above-mentioned one disclosed by Elinson employing an $SnO_2$ thin film, the ones employing an Au thin film [G. Ditter: "Thin Solid Films", 9, 317, (1972)], the ones employing $In_2O_3/SnO_2$ thin film [M. Hartwell and C.G. Fonstad: "IEEE Trans. ED Conf.", 519 (1975)], the ones employing a carbon thin film [H. Araki et al.: Sinkuu (Vacuum), Vol. 26, No. 1, p. 22 (1983), and so forth.

Typically, the surface conduction electron-emitting element has an element constitution as shown in FIG. 23 disclosed by M. Hartwell as mentioned above. In FIG. 23, the numeral 231 denotes a substrate, and the numeral 232 denotes a thin film for electron-emitting region formation (hereinafter referred to as "emittining region-generating thin film") composed of a thin metal oxide film or the like formed in an H-shaped pattern by a sputtering process. On the thin film 232, an electron-emitting region 233 is formed by voltage application called a "forming" treatment as described later. The numeral 234 denotes a thin film having an electron-emitting region.

In such surface conduction electron-emitting elements generally, the electron-emitting region 233 is formed by a voltage application treatment, i.e., forming, of an emitting region-generating thin film 232 prior to use for electron emission. The forming is a treatment of flowing electric current by application of voltage between the both ends of the emitting region-generating thin film 232, thereby the emitting region-generating thin film is locally destroyed, deformed, or denatured to have high electric resistance to form the electron-emitting region 233. The surface conduction electron-emitting element having been subjected to the forming treatment emits electrons from the electron-emitting region on application of voltage to the thin film 234 having the electron-emitting region 233.

Such conventional surface conduction electron-emitting elements involve various problems in practical uses. The inventors of the present invention, after comprehensive investigations, have solved the practical problems as described below.

For example, the inventors of the present invention disclosed a novel surface conduction electron-emitting element in which, as shown in FIG. 24, a fine particle film 244 is provided as the emitting region-generating thin film between electrodes (242, 243) on a substrate 241, and a fine particle film 244 is subjected to voltage application treatment to form an electron-emitting region 245 (Japanese Patent Application Laid-Open No. 2-56822).

In another example of electron sources, in which a number of surface conduction electron-emitting elements are arranged in lines, and the both ends of the respective elements in each line are connected in parallel by wiring (e.g., Japanese Patent Application Laid-Open No. 1-283749 applied by the present inventors).

In recent years, flat-panel display apparatuses employing liquid crystal have become popular in place of CRT as image-forming apparatus. However, the liquid crystal, which does not emit light spontaneously, requires back-light or the like disadvantageously. Therefore, an emissive display device is demanded.

To meet such demands, an image-forming device is disclosed in which an electron source having a number of surface conduction electron-emitting elements arranged therein is combined with a fluorescent material which emits light on receiving electrons from the electron source (e.g., U.S. Pat. No. 5,066,883 applied by the present inventors). Such an image-forming device enables relatively easy production of apparatuses of large picture area, and gives emissive display devices with high image quality.

Display devices and other image-forming apparatuses are necessarily expected to be larger in the picture size, and finer in image quality. In the above-mentioned electron sources having a number of electron-emitting elements arranged therein frequently encounter the problems as below:

1) Defectiveness or failure of the electron-emitting element itself,
2) Disconnection in common wiring, or short circuit between adjacent wiring, and
3) Insufficient insulation between layers at a crossover portion.

SUMMARY OF THE INVENTION

An object of the present invention is to provide an electron source having a number of electron-emitting elements arranged therein which is substantially free from the above problems caused by errors in the production process, in particular the defects or failure of the electron-emitting element itself, and to improve greatly the production yield of electron sources and image-forming devices.

Another object of the present invention is to provide an electron source and a process for producing the electron source, and also to provide an image-forming device and production process thereof, which are free from defect or failure of the electron-emitting elements thereof and exhibiting extremely less deterioration such as defective picture elements or luminance variance, thus forming a high quality image.

A further object of the present invention is to provide an electron source having a number of surface conduction electron-emitting elements arranged therein and an image-forming apparatus employing the electron source, and to improve the production yield thereof and to prevent the above deterioration of image quality, thus forming a high quality image.

According to an aspect of the present invention, there is provided an electron source constituted of a substrate, and an electron-emitting element provided on the substrate: said electron-emitting element comprising a plurality of electrode pairs having an electroconductive film between each of the electrode pairs, and an electron-emitting region being formed on the electroconductive film of selected ones of the electrode pairs.

According to another aspect of the present invention, there is provided an image-forming apparatus, comprising the above electron source, an image-forming member capable of forming an image by irradiation of an electron beam emitted from the electron source, and a modulation means for modulating the electron beam irradiated to the image-forming member corresponding to an inputted image signal.

According to still another aspect of the present invention, there is provided an electron source constituted of a substrate, and an electron-emitting element provided thereon: said electron-emitting element comprising a pair of element electrodes, a third electrode placed between the pair of the element electrodes, electroconductive films between the third electrode and each of the pair of the element electrodes; the electron-emitting region being provided on a selected one of the electroconductive films.

According to a further aspect of the present invention, there is provided an image-forming apparatus, comprising the above electron source having the third electrode, an image-forming member capable of forming an image by irradiation of an electron beam emitted from the electron source, and a modulation means for modulating the electron beam irradiated to the image-forming member corresponding to an inputted image signal.

According to a still further aspect of the present invention, there is provided a process for producing an electron source having a substrate, and an electron-emitting element provided on the substrate: said process comprising steps of forming a plurality of electrode pairs on the substrate, forming a thin film for generating an electron-emitting region between each of the electrode pairs, testing for detecting a defect of the electrode pairs and/or the thin film, and generating the electron-emitting region on the thin film having no defect after the step of detecting a defect.

According to a still further aspect of the present invention, there is provided a process for producing an electron source having a substrate, and an electron-emitting element provided on the substrate: said process comprising steps of forming a plurality of electrode pairs on the substrate, forming a thin film for electron-emitting region generation between each of the electrode pairs, providing an electroconductive member in the vicinity of the emitting region-generating thin film, testing for detecting a defect of the electrode pairs and/or the thin film, forming an conductive path with the electroconductive member between the electrode pair in the vicinity of any defects of the thin film by heat-fusion of the electroconductive member, and generating the electron-emitting region on the thin film having no defect after the step of detecting a defect.

BRIEF DESCRIPTION OF THE DRAWINGS

FIGS. 16A(1) to 16A(6) and FIGS. 16B(4') and 16B(4") are sectional views for explaining the process of producing the surface conduction electron-emitting element of Embodiment 3 of the present invention.

FIG. 17 is a partial perspective view of one type of the display device of Embodiment 3 of the present invention.

DETAILED DESCRIPTION OF PREFERRED EMBODIMENT

The problems caused by errors in producing an electron source having arrangement of a number of electron-emitting elements and image forming device employing the electron source are as below:

a) Electrical short circuit (failure)

b) Electrical disconnection (failure)

c) Faulty characteristics in electron emission (defectiveness)

The above defectiveness and failure are comprehensively investigated by the inventors of the present invention. As the results, the interesting information as described below has been obtained regarding the electron-emitting element, in particular, the surface conduction electron-emitting element. It is explained by reference to FIGS. 22(1) to 22 (6).

Figure 22:
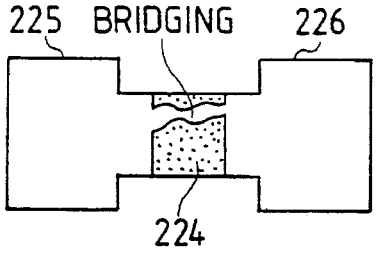
FIGS. 22(1) to 22(6) are plan views showing examples of defects and failure of a surface conduction electron-emitting element.
Figure 22:
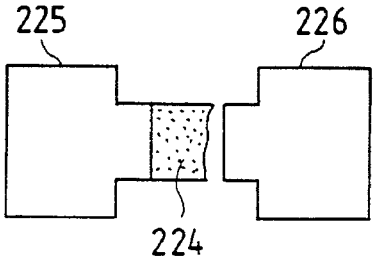
Figure 22:
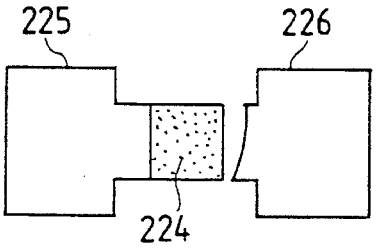
Figure 22:
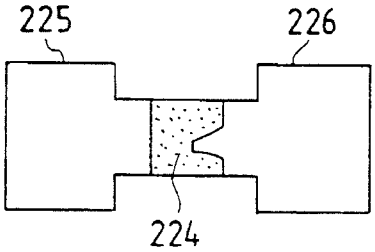
Figure 22:
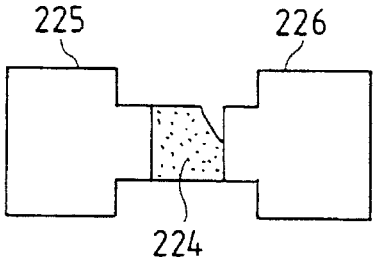
Figure 22:
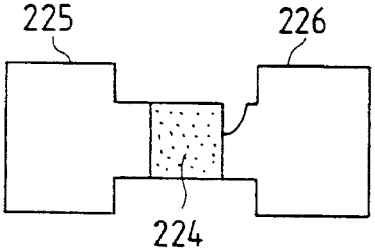
Figure 23:
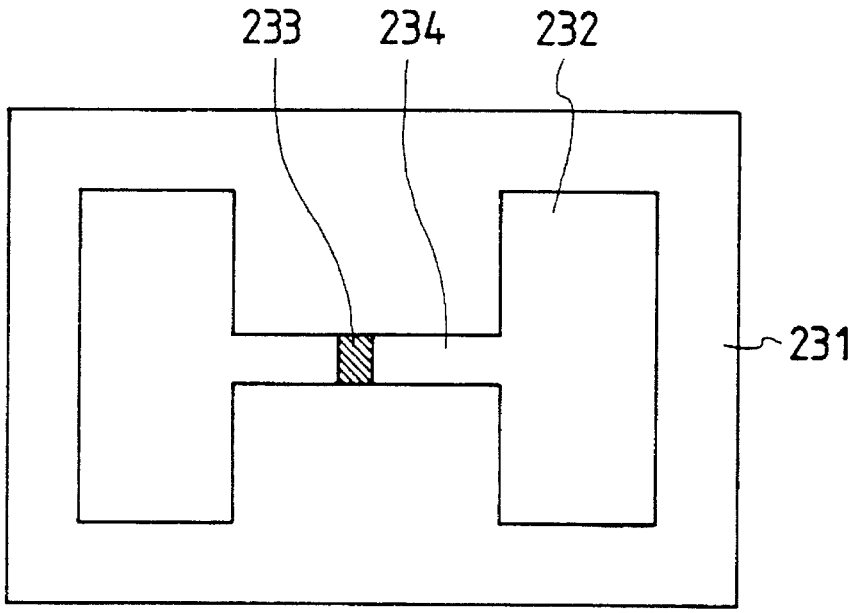
FIG. 23 is a plan view of a conventional surface conduction electron-emitting element.
Figure 24:
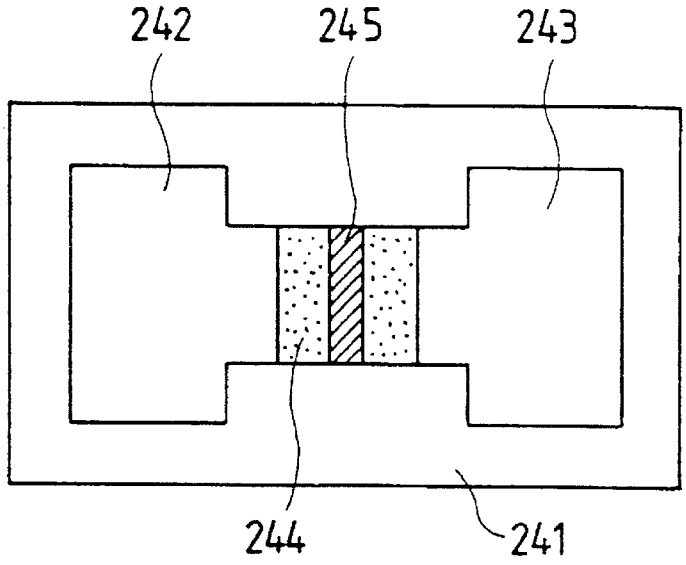
FIG. 24 is a plan view of another conventional surface conduction electron-emitting element.

FIGS. 22(1) to 22(6) are plan views of substrates having a surface conduction electron-emitting element thereon before the forming treatment for electron-emitting region formation.

The electrical short circuit in the surface conduction electron-emitting element is caused by bridging between element electrodes 225, 226 by an electroconductive substance as shown in FIG. 22(1). Such bridging naturally makes infeasible the effective voltage application to the emitting region-generating thin film 224, whereby the forming treatment (namely, electric current flowing treatment of the emitting region-generating thin film 224) or driving is made impracticable. In some cases, such electrical short circuit causes over-current, thereby a driving circuit is broken.

The aforementioned bridging results mainly from imperfect etching caused by sticking of dust on the photoresist or by local irregularity of the etchant on photolithographic formation of element electrodes 225, 226, or otherwise, in the case of formation of the electrode pattern by a lift-off method, the bridging is caused by a peeled fraction formed by imperfect washing after the lifting-off and lying between the element electrodes 225, 226.

The electrical disconnection in the surface conduction electron-emitting element is caused by disconnection of the emitting region-generating thin film 224 at any point between the formed element electrodes 225, 226 as shown in FIGS. 22(2) and 22(3). Such disconnection naturally makes impracticable the effective application of voltage to the emitting region-generating thin film 224, and renders impracticable the aforementioned forming treatment and practical driving.

The electrical disconnection shown in FIG. 22(2) occurs in most cases is caused by positional deviation of a mask pattern during formation of the emitting region-generating thin film 224 or by partial exfoliation of the thin film 224 after its formation.

The electrical disconnection shown in FIG. 22(3) is caused in most cases by a defect of the formed film of element electrodes 225, 226, or by partial exfoliation of the emitting region-generating thin film 224 after its formation.

The faulty electron-emission characteristics in the surface conduction electron-emitting element is caused by incomplete short-circuiting or incomplete disconnection as shown in FIGS. 22(4) to 22(6). With such faulty characteristics, the voltage is not effectively applied to the emitting region-Generating thin film 224, or the electric field or the electric energy deviates from the designed value, whereby the forming treatment or the voltage application in driving cannot be conducted as designed, and the emitted current (outputted electron beam) remarkably decreases. The present invention is made on the basis of the above findings. The preferred embodiments of the present invention are described below in detail.

In a first feature of the present invention, a plurality of emitting region-Generating thin films are provided on an electron-emitting element in case of occurrence of.defectiveness or failure in the electron-emitting element.

According to the present invention, an electron-emitting region can be formed by use of a remaining normal emitting region-Generating thin film even when defectiveness or failure arises in some of the plurality of the emitting region-Generating thin films.

The plurality of emitting region-Generating thin films are preferably formed between the element electrodes electrically in series or in parallel as described later.

When defectiveness or failure arises in an emitting region-generating thin film, that failing or defective thin film is not subjected to the forming treatment, and effective driving signal is not applied to the failing or defective thin film.

In a second feature of the present invention, a means for switching electrical connection of the emitting region-generating thin films.

An example of the means for switching electrical connection is a selecting electrode provided on the electron-emitting element for selectively switching the electron-emitting regions. In utilizing the selecting electrode, satisfactory electron-emitting regions (or conversely defective or failing electron-emitting regions) are memorized preliminarily in a memory, and according to the information read out from the memory, the driving signal is selectively applied to the selecting electrode and the element electrode.

Another example of the means for switching electrical connection is a heat-fusible electroconductive member provided in proximity to each of the electron-emitting region, which is heated at the section where the electric connection is to be switched. With this heat-fusible member, a new electroconductive path is formed so that voltage may not be applied practically to the electron-emitting region exhibiting failure or defectiveness. For selective heating, for example, an infrared laser beam is irradiated selectively to a desired spot.

The means for switching electrical connection, according to the present invention, enables electrical forming treatment selectively of thin films which exhibit neither defectiveness nor failure. Additionally, driving signals are applied selectively to normal electron-emitting region, thereby undesirable excessive power consumption and over-current are prevented at the emitting region-generating thin films exhibiting failure or defectiveness.

In a third feature of the present invention, when defectiveness or failure arises in any of the plurality of electron-emitting regions of the electron-emitting element, the electrical conditions for driving the normal electron-emitting regions are corrected corresponding to the number of the defective or failing electron-emitting regions. The correction of the electrical conditions for driving is conducted by adjusting the driving voltage, or length or number of the driving pulses applied to the electron-emitting element.

The driving voltage is adjusted in correspondence with the electron emission characteristics of each normal electron-emitting element with reference to the voltage applied to the electron-emitting region of the element.

The adjustment of the length or number of the driving pulse is conducted by increasing it approximately in proportion to the ratio of (number of electron-emitting regions in one electron-emitting element)/(number of normal electron-emitting regions in the element).

By the adjustment of the driving conditions of the electron-emitting element exhibiting defectiveness or failure, an electron beam output with normal intensity and a normal charge quantity can be obtained at approximately the same level as the normal electron-emitting element according to the present invention.

The above means may be practiced solely or in combination of two or more thereof. The present invention is suitably applicable particularly to surface conduction electron-emitting elements.

The electron-emitting region on the thin film is constituted of electroconductive fine particles of several ten Å in diameter, and other portion of the thin film is constituted of a fine particle film which is a film formed from fine particles. The fine structure of the fine particle film includes dispersion of individual separate particles, and aggregation (planar or spherical) of fine particles (including an island pattern). The thin film having an electron-emitting region may be a carbon film on which electroconductive fine particles are dispersed.

The material for constructing the thin film having an electron-emitting region is exemplified by metals such as Pd, Ru, Ag, Au, Ti, In, Cu, Cr, Fe, Zn, Sn, Ta, W, Nb, Mo, Rh, Hf, Re, Ir, Pt, A1, Co, Ni, Cs, Ba, and Pb; oxides such as PdO, $SnO_2$, $In_2O_3$, PbO, and $Sb_2O_3$; borides such as $HfB_2$, $ZrB_2$, $LAB_6$, $CeB_6$, $YB_4$, and $GdB_4$; carbides such as TiC, ZrC, HfC, TaC, SiC, and WC; nitrides such as TiN, ZrN, and HfN; semiconductors such as Si, and Ge; carbon, and the like.

The thin film having an electron-emitting region is formed by vacuum vapor deposition, sputtering, chemical vapor phase deposition, dispersion coating, dipping, spinner coating, or a like method.

Embodiment 1

Embodiment 1 of the present invention is described by reference to FIGS. 1 to 10.

Figure 1:
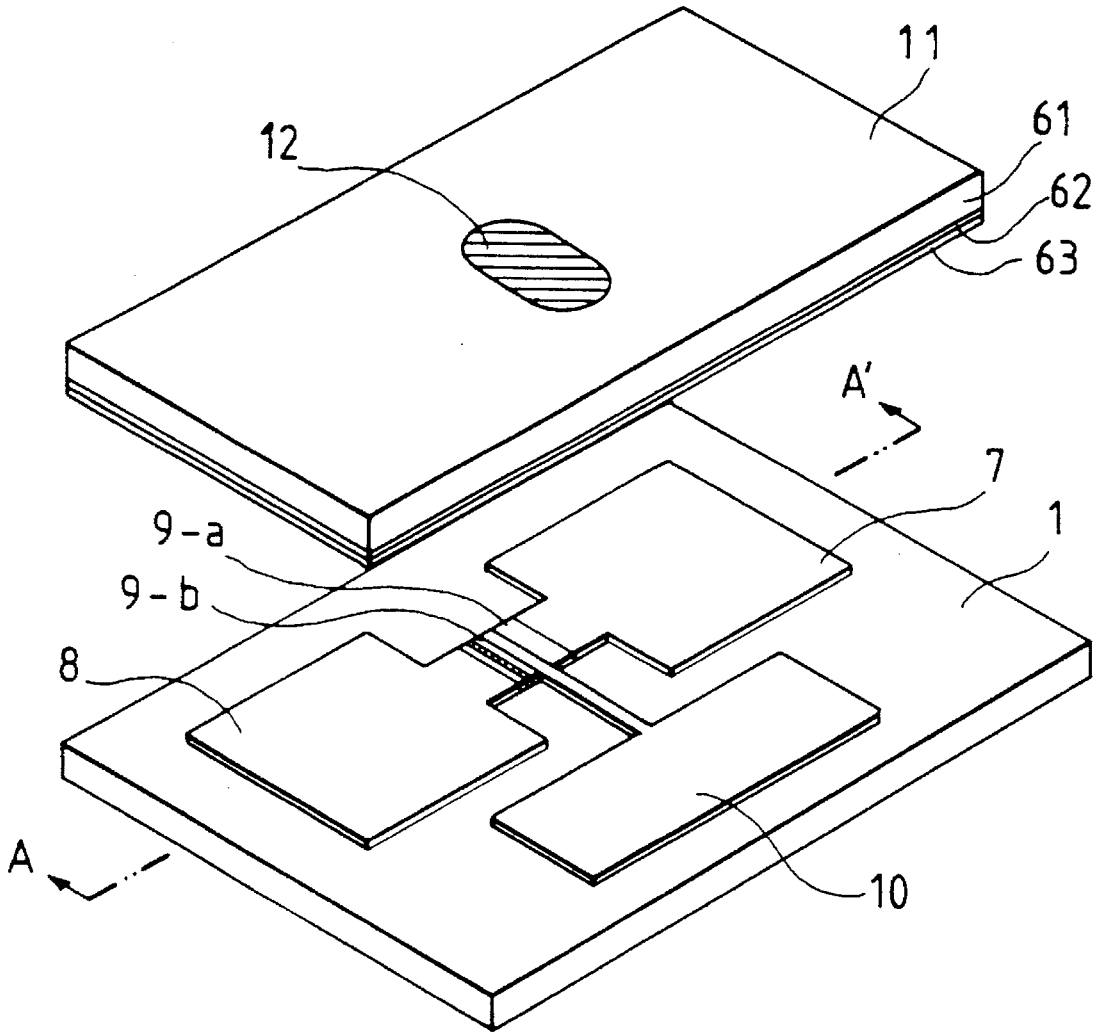
FIG. 1 is a perspective view of a part of a display device of Embodiment 1 of the present invention.
Figure 2A:
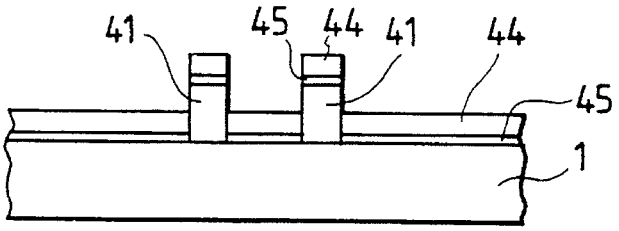
FIGS. 2(*a*) to 2(*e*) are cross-sectional views for explaining the process for producing the surface conduction electron-emitting element of Embodiment 1.
Figure 2B:
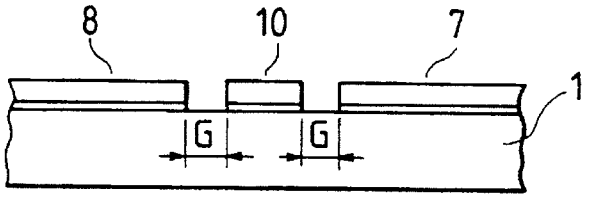
Figure 2C:
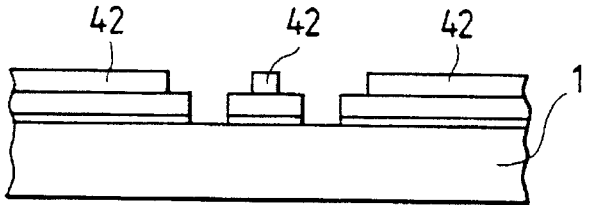
Figure 2D:
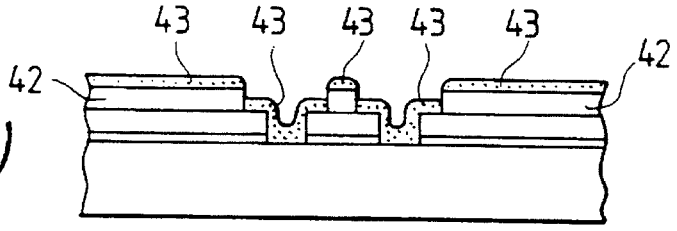
Figure 2E:
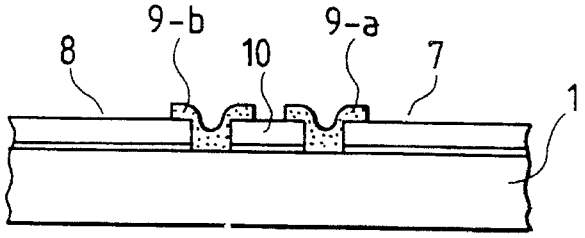

FIG. 1 is a perspective view of a portion of a display device of the present invention, showing one of surface conduction emitting elements as an electron source and a face plate comprising a fluorescent substance as an image-forming member. The surface conduction emitting element in FIG. 1 is constructed of an insulating substrate 1, (e.g., made of glass), electrodes 7,8, thin films 9-*a*, 9-*b*, for electron-emitting region formation (electron-emitting region formed in 9-*b*), and a selecting electrode 10. The face plate 11 of the display device is constructed of a light-transmissive plate 61 (e.g., made of glass), having on the inside face thereof a metal back 63 and a fluorescent material 62 generally known for CRT use. Further, under the fluorescent material 62, a light-transmissive electrode, (e.g., made of an ITO thin film) may be provided which are known in the application field of CRT. A voltage (e.g., 10 KV) is applied to the metal back 63 (or the light-transmissive electrode) from a high voltage power source not shown in the drawing. When an electron beam is emitted from the surface conduction emitting element, a portion of the fluorescent material is illuminated by the electron beam to emit visible light. The face plate also constitutes a portion of a vacuum envelope (not shown in the drawing). The interior of the envelope is maintained at a vacuum (e.g., $10^{-6}$ Torr).

The surface conduction emitting element of this Embodiment is prepared in a manner as follows, for example. FIGS. 2(*a*) to 2(*e*) illustrate sectional views taken along line A-A' of the substrate shown in FIG. 1 to explain the production process. FIGS. 2(*a*) to 2(*e*) are drawn in an arbitrary size scale for convenience of illustration.

(Step a) On a soda lime glass substrate 1 having been washed sufficiently with pure water, a surfactant, and an organic solvent, is formed a pattern 41 for element electrodes 7, 8 and a selecting electrode 10 with a photoresist (RD-2000N-41, made by Hitachi Chemical Co., Ltd.), and thereon a Ti layer 45 of 50 Å thick, and an Ni layer 44 of 1000 Å thick are laminated successively by vacuum vapor deposition.

(Step b) The photoresist pattern 41 is dissolved off with an organic solvent, and a part of the Ni/Ti deposition film 44/45 is lifted off to form element electrodes 7, 8 and a selecting electrode 10 constructed of Ni/Ti. The gaps G between the element electrode 7, 8 and the selecting electrode are 2 microns, for example.

(Step c) A mask pattern 42 is formed by deposition of a Cr film of 100 Å thick by vacuum vapor deposition for formation of an emitting region-generating thin film.

(Step d) On the above substrate 1, an organic Pd solution (CCP 4230, made by Okuno Seiyaku K.K.) is applied while the substrate 1 is being turned by use of a spinner, and the applied matter is baked to form a thin film 43 composed of fine Pd particles.

(Step e) The thin film 43 and the Cr deposition film 42 are lifted off by wet etching with an acid etchant to form emitting region-generating thin films 9-*a*, 9-*b*.

The production process of the element electrodes 7, 8, a selective electrode 10, and thin films 9-*a*, 9-*b* are described above. The produced electron-emitting element substrate is tested for defectiveness or failure.

In a first example of the test method, an abnormal shape of the element electrodes 7, 8, the selecting electrode 10, or the thin film 9-*a*, 9-*b* for electron-emitting region formation is detected by use of combination of an image pickup apparatus like an industrial TV camera having a magnifying lens with an image processor. That is, the image on the upper face of the face plate is taken by an image pickup apparatus and the image data is once stored in an image memory, and the memorized image data is compared by pattern matching with another image data having preliminarily been memorized of a normal substrate. When the both image data coincide with each other, the substrate is evaluated as being normal. The defects and failure shown in FIGS. 22(1) to 22(6) are detectable in most cases with this test method. The evaluation results for respective electron-emitting region are stored in a test result memory mentioned later.

Figure 3:
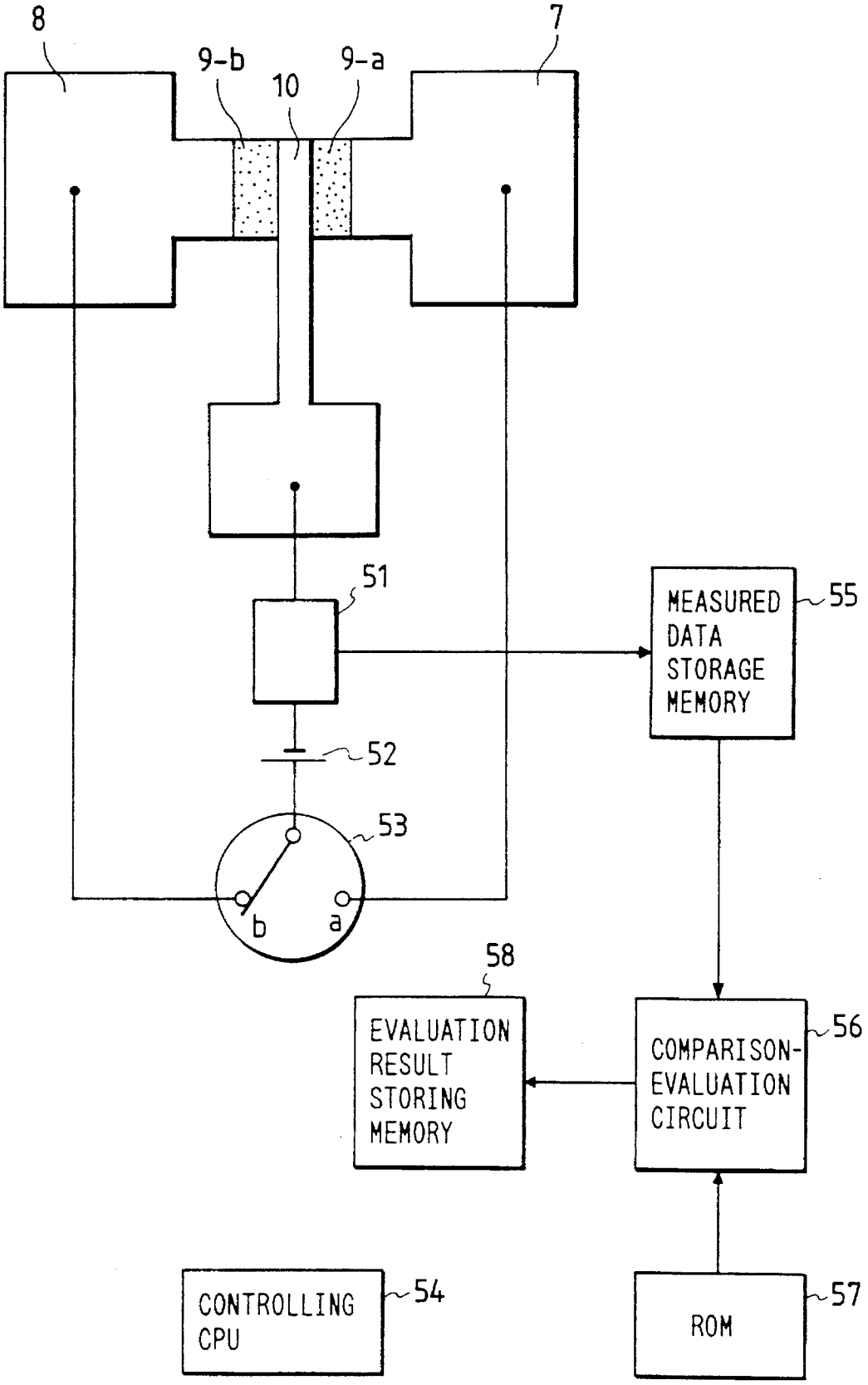
FIG. 3 is a simplified circuit diagram for explaining the step for testing the surface conduction electron-emitting element of Embodiment 1.

In a second example of the test method, an abnormal state is detected by measuring the electric resistance, namely a current intensity flowing a test sample on application of a predetermined voltage. FIG. 3 is a simplified block diagram of a circuit for explaining this test method. The circuit for detection of FIG. 3 comprises a current-measuring circuit 51, a constant voltage power source 52, a change-over switch 53, a controlling CPU 54, a measured data storing memory 55, comparison-evaluation circuit 56, a ROM 57

(read-only memory) in which normal current value is memorized preliminarily, and an evaluation result storing memory 58.

The current-measuring circuit 51 has sufficiently low impedance and is used for measuring the electric current flowing through a test sample on application of the output voltage of the constant voltage source 52, and outputs the measured data to the measured data storing memory 55. The constant voltage source 52 generates a voltage at such a level that the test sample is not deteriorated by the current flowing through the sample. The constant voltage source 52 has a current limiter since some sample may have extremely low voltage, like a sample having a short-circuit defect. The change-over switch 53 is used for switching the test sample, and may be a mechanical switch or a semiconductor like a transistor. FIG. 3 shows an example of the measurement of the electric resistance of the 9-*b* side of the emitting region-generating thin film. The resistance of the 9-*a* side can be measured by reversing the connection of the change-over switch 53.

In FIG. 3, control signal from the CPU 54 is not shown for simplification of the drawing. The controlling CPU 54 controls operation of the current measuring circuit 51, the constant voltage source 52, the change-over switch 53, the measured data storing memory 55, the comparison-evaluation memory 56, the ROM 57, and the evaluation result-storing memory 58.

Under the control by the controlling CPU, the test is conducted, for example, in the steps as follows. Firstly, the CPU 54 sends a control signal to the change-over switch 53 to select the "a" side. Then the CPU 54 sends a control signal to the constant voltage source 52 to output the measurement voltage. Further, the CPU 54 outputs control signals suitably to the measuring circuit 51 to measure the current intensity and write the measured data into the measured data storing memory 55. By the above operation, the current flowing from the element electrode 7 through the emitting region-generating thin film 9-*a* to the selecting electrode 10, and the measured data is written in the measured data storing memory 55. Then a control signal is sent to the constant voltage source 52 to stop the measuring voltage output, and a control signal is sent to the change-over switch 53 to change the connection from the "a" side to the "b" side. Thereafter in the same manner as above, the intensity of the current flowing between the element electrode 8 and the selecting electrode 10, and the measured data is written in the data storing memory 55.

The CPU 54 send a control signal respectively to measured data storing memory 55 and ROM 57 to output the stored data to the comparison-evaluation circuit 56. Thereby, the measured data is inputted from the measured data storage memory 55, and the current intensity value of a normal test sample is inputted from the ROM 57, to the comparison-evaluation circuit 56. The comparison-evaluation circuit 56 compares the above two current values and judges whether the measured data is normal or not. Generally, the current intensity value of the test sample varies to some extent even with a normal sample not showing defectiveness nor failure described in FIGS. 22(1) to 22(6). The ROM 57 memorizes the mean value of the variation. The comparison-evaluation circuit 56 judges the occurrence of failure as shown in FIGS. 22(5) to 22(6) if the measured value is in the range of from 1/100 times to 1/2 times the value read out from the ROM 57; judges the occurrence of failure as shown in FIG. 22(4) if the measured value is in the range of from 3/2 times to 10 times the value; and judges the occurrence of failure as shown in FIG. 22(1) if the measured value is 10 times the value. Naturally, the evaluation criteria are shown only as an example, and the current value for the evaluation may be varies in accordance with the nature of the defectiveness and failure. Furthermore, the comparison and evaluation may be made by reference to the upper limit and the lower limit memorized by the ROM 57.

The evaluation results are stored in the data storing memory 55. By the above-mentioned procedure, defectiveness and failure are detected electrically.

According to the above test results, the emitting region-generating thin film is subjected to electric forming treatment, which is explained by reference to FIG. 4. The circuit for forming treatment of FIG. 4 comprises a forming power source 61, a change-over switch 53 similar to the one explained in FIG. 3, a controlling CPU 64, and a evaluation result storing memory 68. The evaluation result storing memory 68 has preliminarily memorized the test results obtained optically or electrically as mentioned above. The controlling CPU 64 controls suitably the operation of the forming power source 61, the change-over switch 53, and the evaluation result storing memory 68.

Firstly, the control CPU 64 reads out the test results from the evaluation result storing memory 68. The test results include three cases: a first case in which both the 9-*a* side and the 9-*b* side of the emitting region-generating thin film are normal, a second case in which one of the 9-*a* side and the 9-*b* side of the thin film only is normal, and a third case in which both the 9-*a* side and the 9-*b* side are abnormal.

Figure 5:
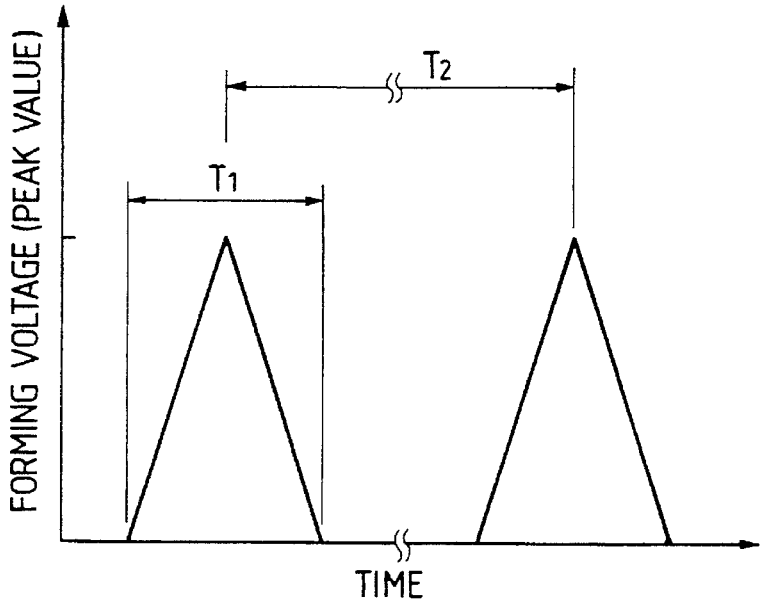
FIG. 5 is a drawing showing an example of applied voltage waveforms for the forming.

In the above first case in which both sides of the emitting region-generating thin film are normal, one of the two thin films is treated for electric forming. In this Embodiment, the controlling CPU 64 sends a signal to the change-over switch to select and connect the "a" side. Then the controlling CPU 64 send a signal to the forming power source 61 to output the predetermined forming voltage. An example of the predetermined forming voltage is shown in FIG. 5. In this example, the forming voltage is applied as triangular pulses with $T_1$ of 1 msec, $T_2$ of 10 msec, and the peak voltage of 5 V, for 60 seconds under a vacuum of $10^{-6}$ Torr. Thereby an electron-emitting region is formed on a portion 9-*a* of the emitting region-generating thin film. The electron-emitting region comprises dispersed fine particles mainly composed of palladium, the fine particles having an average diameter of 30 Å. The forming voltage is not limited to the one in the above waveform but may be in any other waveform such as a rectangular wave. The wave height, the pulse width, and the pulse interval are not limited to the above values provided that the electron-emitting region is formed satisfactorily.

In the case where only one of the emitting region-generating thin films is in a normal state, the controlling CPU 64 sends a control signal to the change-over switch 53 to connect the normal side of the emitting region-generating thin film. FIG. 4 shows an example in which the portion 9-*b* of the thin film is normal and is connected. The electrical forming treatment is conducted as described above to form an electron-emitting region on the emitting region-generating thin film.

In extremely rare case where the both portions of the emitting region-generating thin film are abnormal, the controlling CPU 64 does not output a signal to conduct the forming treatment. If the defects or the failing points are repairable, the emitting region-generating thin films is repaired and tested again. If the repair is difficult, the materials are reused desirably as the starting materials.

Figure 4:
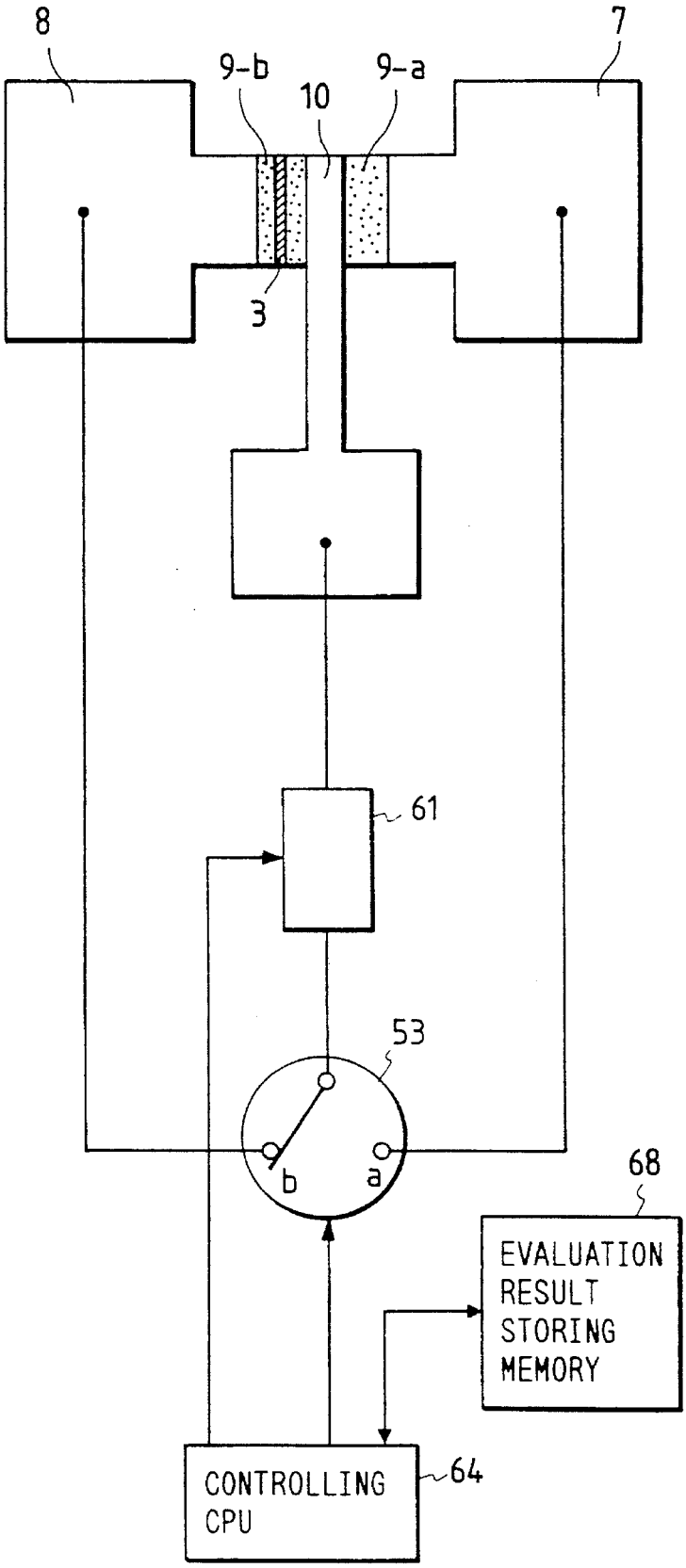
FIG. 4 is a simplified circuit diagram for explaining the process of forming of the surface conduction electron-emitting element of Embodiment 1.

The electric circuit for testing shown in FIG. 3 and the electric circuit for forming treatment shown in FIG. 4 resemble each other in construction. Therefore, the both circuit can be unified into one circuit. In the unification, the circuit construction of FIG. 3 is employed basically, and the current-measuring circuit 51 is designed to have sufficiently low impedance so as not to cause difficulty in forming treatment, and further the constant voltage power source 52 is replaced by another power source which is capable of outputting both the constant voltage for measurement and the pulse voltage for the forming treatment. Naturally the controlling CPU 54 serves for control-programming of testing as well as for control-programming of forming treatment.

As described above, an electron-emitting region has been formed selectively only on the normal one of the two emitting region-generating thin films. The output characteristics of the obtained surface conduction emitting element are described, and further the driving method of the surface conduction emitting element for use for image-forming apparatus is explained.

Figure 6:
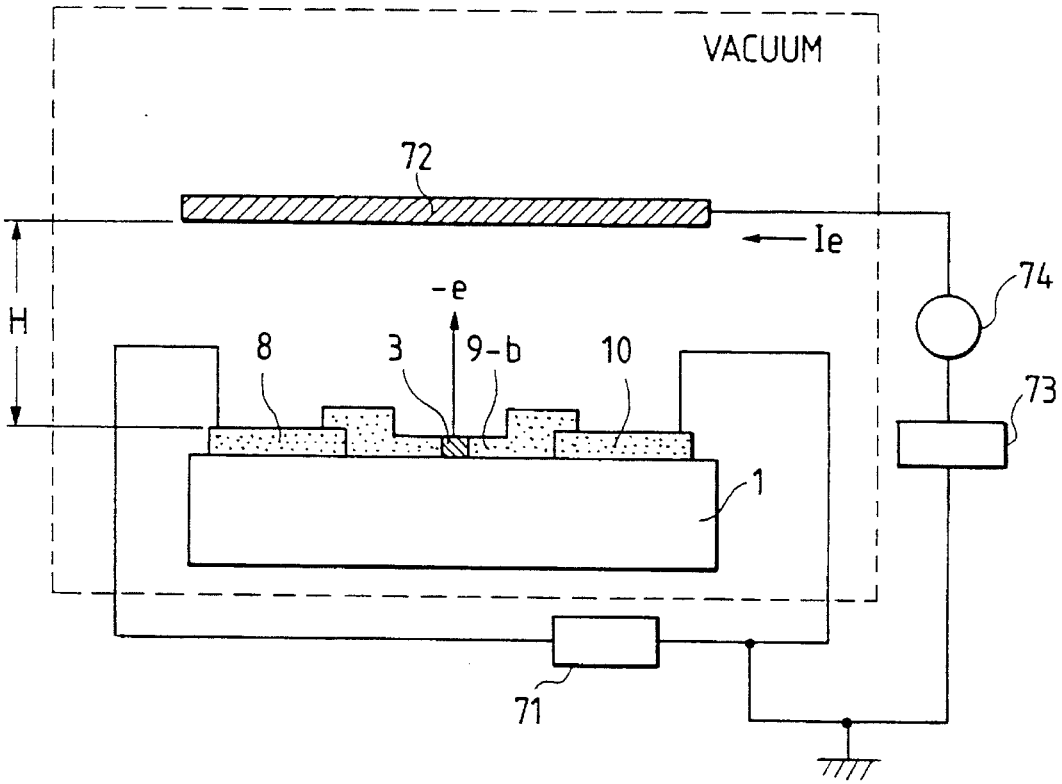
FIG. 6 is a diagram showing an example of a device for evaluating the characteristics of the surface conduction electron-emitting element.

FIG. 6 illustrates roughly a measurement-evaluation device for measuring the output characteristics. The device comprises a power source 71 for applying an element voltage (voltage applied to the element) Vf to the surface conduction emitting element, an anode electrode 72 for capturing emission current Ie emitted from the surface conduction emitting element, a high voltage power source 73 for applying voltage to the anode electrode 72, and an ammeter 74 for measuring the emission current. The electron-emitting element and the anode 72 are placed in a vacuum chamber equipped with tools such as vacuum pump and a manometer necessary for a vacuum apparatus (not shown in the drawing) so that the desired measurement and evaluation can be conducted under vacuum. The measurement can be conducted at an anode voltage applied by the high voltage power source 73 in the range of from 1 KV to 10 KV, and at the distance between the anode electrode and the electron-emitting element in the range of from 3 mm to 8 mm. FIG. 6 shows, as an example, measurement of electron emission from the electron-emitting region 3 at the 9-*b* side between the selecting electrode 10 and the element electrode 8 on one of the two emitting region-generating thin films on the surface conduction electron-emitting element. In order to evaluate the 9*a* side, the power source 71 is connected between the selecting electrode 10 and the element electrode 7 (not shown in the drawing).

Figure 7:
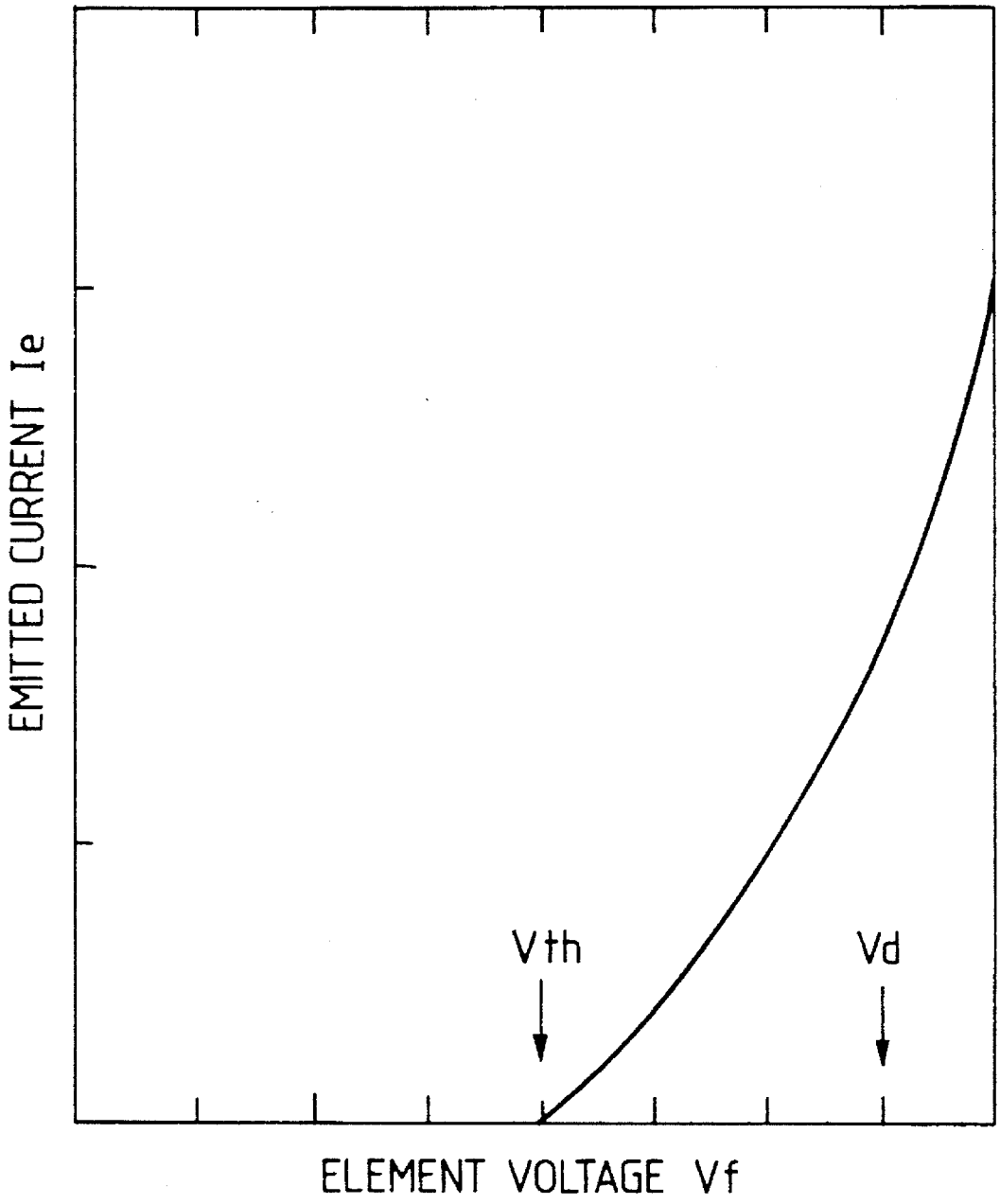
FIG. 7 is a diagram showing an example of a typical characteristic curve of the element voltage (Vf)-emitted current (Ie).

FIG. 7 shows a typical Ie-Vf characteristics of a normal surface conduction electron-emitting element as measured with the above measurement-evaluation apparatus. The characteristic curve is shown in arbitrary units since the absolute value of the output characteristics depends on the size and the shape of the electron-emitting element, etc. As is clear in FIG. 7, the three characteristics are included in the relation between the element voltage Vf and the emission current Ie in a normal surface conduction electron-emitting element.

Firstly, in this element, the emission current Ie increases rapidly by application of voltage higher than a certain voltage (a threshold voltage, shown by Vth in FIG. 8), and the emission voltage Ie is nearly zero at the voltage lower than the threshold voltage. Thus, the element is a non-linear element having a definite threshold voltage Vth to the emission current Ie.

Secondary, the emission current is controllable by the element voltage Vf because of dependence of the emission current Ie on the element voltage Vf.

Thirdly, the quantity of electric charge of the emitted electrons captured by the anode electrode 72 depends on the time of application of the element voltage Vf. Therefore, the quantity of the electric charge captured by the anode electrode 72 is controllable by the time of application of element voltage Vf.

In applying the element to an image-forming apparatus by utilizing the above characteristics, electrons are made to be emitted by application of an element voltage higher than Vth in accordance with the image to be formed, and the element voltage Vf or the voltage application time is controlled in accordance with the density of the image. Three examples are explained by reference to FIGS. 8 to 10, which show circuit constitution for driving the element in accordance with inputted image signals in a display unit of FIG. 1 employing a surface conduction electron-emitting element having been suitably treated for forming in a method shown in FIG. 4. In these examples, the normal electron-emitting region is formed on the 9-*b* side of the emitting region-generating thin film.

Figure 8:
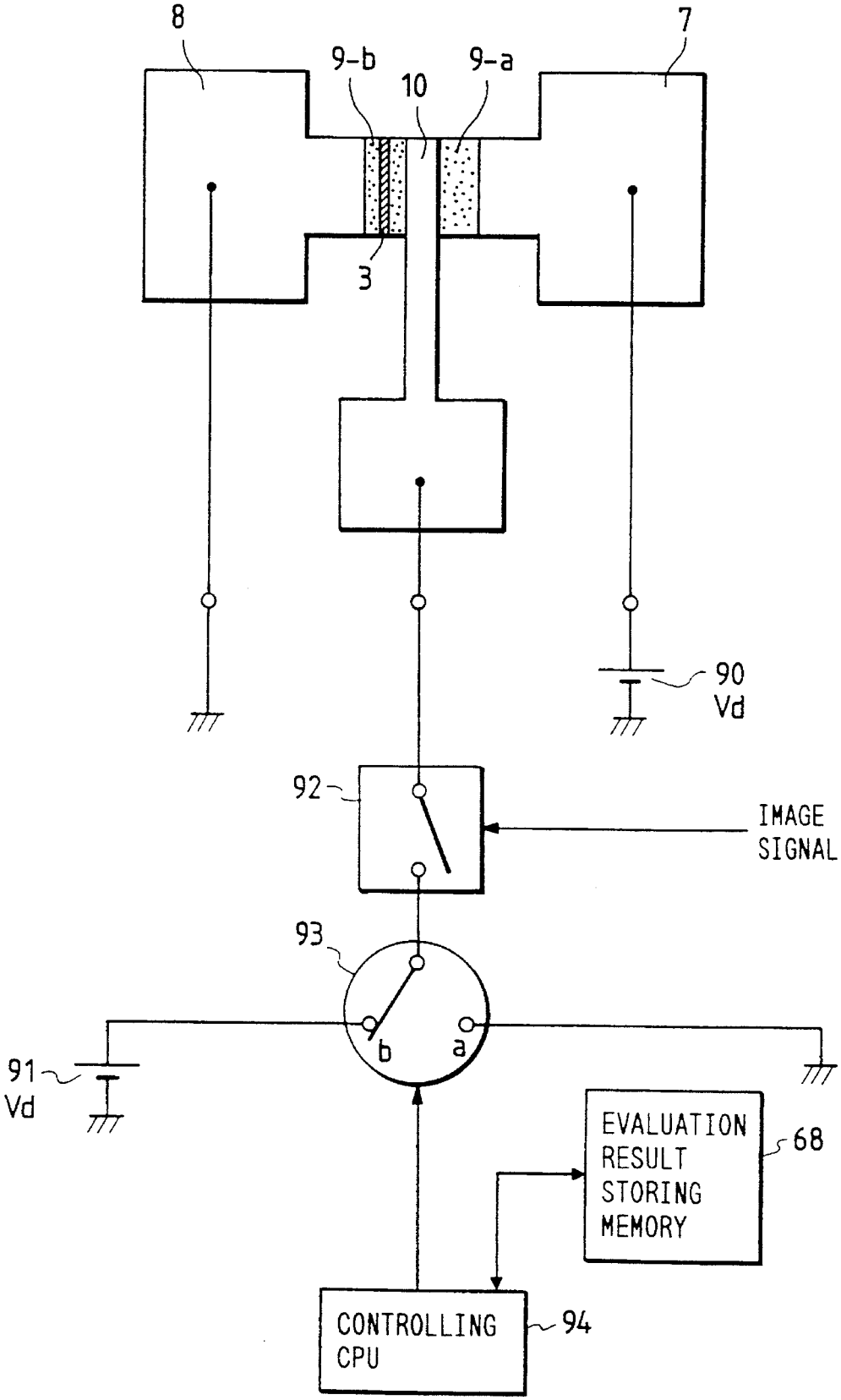
FIG. 8 is a simplified circuit diagram for explaining a first driving method of the display device of Embodiment 1 of the present invention.

In FIG. 8, the numerals 90 and 91 denote a voltage source for generating a voltage Vd which is higher than Vth of the surface conduction electron-emitting element; the numeral 92 denotes a pulse width modulation circuit; 93 a change-over switch; 94, a controlling CPU; and 68, an evaluation result storage memory. In the example of FIG. 8, the element electrodes 7, 8 are electrically connected respectively to output voltage Vd of the voltage source 90 and a Ground level. To the selecting electrode 10 of the surface conduction electron-emitting element, driving signals are given to drive selectively the normal electron-emitting region in accordance with the image signals from the outside. That is, the controlling CPU 94 sends control signals to the change-over switch 93 in accordance with the evaluation results read out form the evaluation result storing memory 68, whereby the driving voltage is selected for driving the normal electron-emitting region. For example, in this example, the terminal "b" of the change-over switch is made to be connected to the circuit to select the output voltage Vd of the voltage source 91. (When the normal electron-emitting region is formed on the 9-*a* side of the emitting region-generating thin film, the terminal "a" is connected to select the ground level.)

The pulse width modulation circuit 92 modulates the driving voltage selected by the change-over switch into a pulse voltage having width corresponding to the image signal given from the outside, and gives the modulated voltage to the selecting electrode 10. By this modulation, a pulse of longer duration is applied to the selecting electrode 10 for higher level of luminance of the image signal.

In this example, as describe above, it is practicable to emit electrons only from the normal electron-emitting region by applying a different fixed potential to the element electrodes 7 and 8 respectively and applying selectively, to the selecting electrode 10, a potential equal to the one of the above different fixed potentials. In such a manner, disadvantages of unnecessary power consumption or over-current can be caused since an effective voltage is not applied because of no voltage difference between the both ends of the defective or failing emitting region-generating thin film. Thus an image display having excellent gradation is obtainable by modulating the driving pulse width of the driving voltage applied to the selecting electrode in accordance with the external image signal. The voltage sources 90 and 91 for generating the constant voltage Vd may be unified into one power source.

Figure 9:
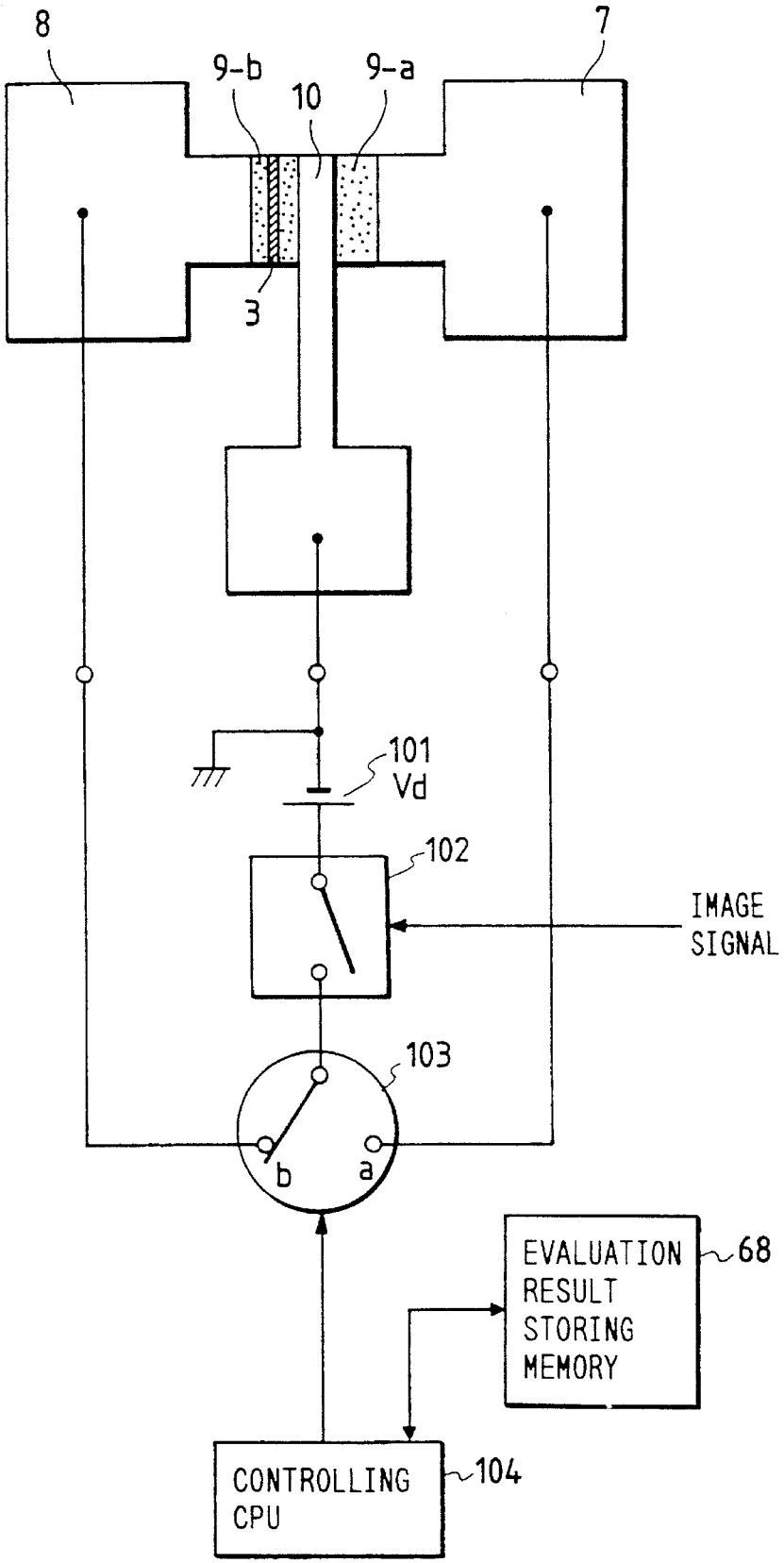
FIG. 9 is a simplified circuit diagram for explaining a second driving method of the display device of Embodiment 1 of the present invention.

Another driving method is described by reference to FIG. 9. In FIG. 9, the numeral 101 denotes a voltage source which generates a voltage Vd higher than Vth of the surface conduction electron-emitting element; 102, a pulse width modulation circuit; 103, a change-over switch; 104, a controlling CPU; and 68, an evaluation result storing memory. In the driving method of the surface conduction electron-emitting element in this example, a fixed potential (ground level) is applied to the selecting electrode 10. A driving signal which is modified in pulse width in accordance with the image signal from the outside is selectively applied only to a normal electron-emitting region side. That is, the controlling CPU 104 send a signal to the change-over switch 103 according to the evaluation result read out from the evaluation result storing memory 68, whereby the element electrode at the normal electron-emitting region side only is selectively connected to the voltage source 101 and the pulse width modulation circuit 102. In FIGS. 2(*a*) to 2(*e*), for example, the terminal "b" of the change-over switch 103 is connected, and the driving signal is applied to the electron-emitting region 3 on the 9-*b* side of the emitting region-generating thin film the driving signal applied to the electron-emitting region 3 is a pulse voltage signal having a wave height Vd of the voltage source 101 and having a pulse width which has been modified by the pulse width modulation circuit 102 in accordance with the image signal from the outside. A pulse of a larger time width is applied to the electron-emitting region 3 for a higher luminance level of the image signal.

In this example, as described above, it is practicable to emit electrons from only the normal electron-emitting region by applying a fixed potential (ground level) to the selecting electrode 10 and applying a driving signal selectively to the element electrode of the normal electron-emitting region side. In this method, since no current path is formed in the defective or failed emitting region-generating thin film, disadvantages of unnecessary power consumption, over-current, etc. are not caused. Further in this example, image display with high gradation is practicable by modification of the pulse width of the driving signal applied to the element electrode in accordance with the image signal inputted from the outside.

Figure 10:
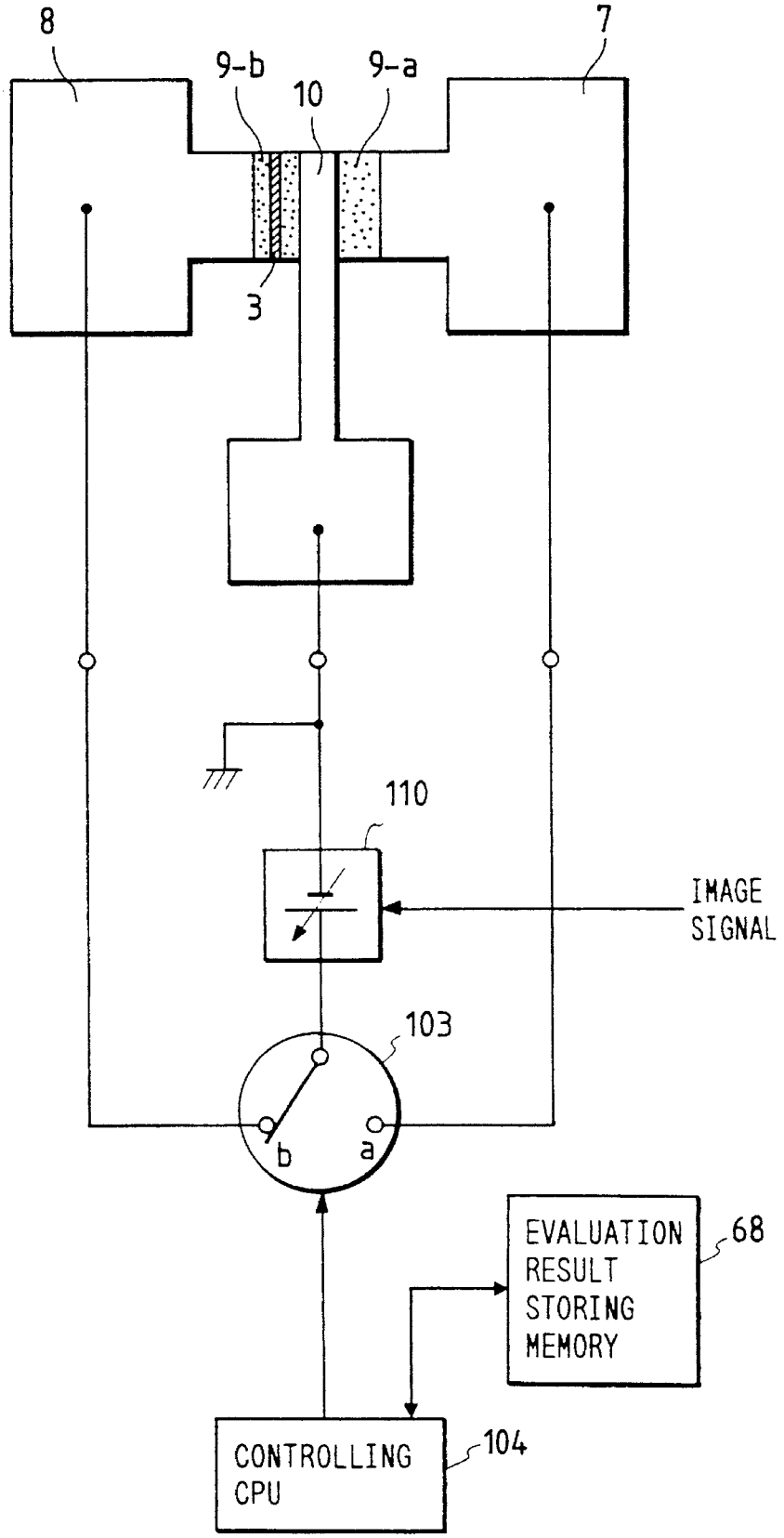
FIG. 10 is a simplified circuit diagram for explaining a third driving method of the display device of Embodiment 1 of the present invention.

A still another example of the method of driving the element is described by reference to FIG. 10. In FIG. 10, the numeral 110 denotes a voltage modulation circuit for modulating the output voltage in accordance with the inputted image signal, and other constitutional elements are the same as in FIG. 9. In this example, the evaluation result storing memory 68, the controlling CPU 104, and the change-over switch 103 function in the same manner as in the example shown in FIG. 9. In this example, however, a voltage modulation system is employed, while a pulse width modulation system is employed in the above example. In this example, the voltage modulation circuit 110 modifies suitably the output voltage to adjust the intensity of the electron beam emitted from the surface conduction electron-emitting element so that a display is made with necessary luminance in accordance with an image signal inputted from the out side. For example, the higher the luminance level of the image signal, the higher is the output voltage. In this driving method also, image display with high gradation is practicable without disadvantages of unnecessary power consumption, over-current, etc. in the defective or failed emitting region-generating thin film, similarly as in the example of FIG. 9.

The production method, the testing method, and the driving method in an image display apparatus of a first embodiment of the present invention are described above.

The explanation of FIGS. 1 to 10 is made regarding a single element of the surface conduction electron-emitting element for simplicity of description. Naturally, the present invention is not limited to single elements, but also applicable to multiple elements. In an image-forming apparatus, for example, a number of elements are generally formed on a substrate. In such cases, an image-forming apparatus with high gradation can be produced in a high yield by applying, to each of the elements, the production method, the test method, the forming method, the driving method, etc. as described.

Embodiment 2

A second embodiment of the present invention is described by reference to FIGS. 11 to 14.

Figure 11:
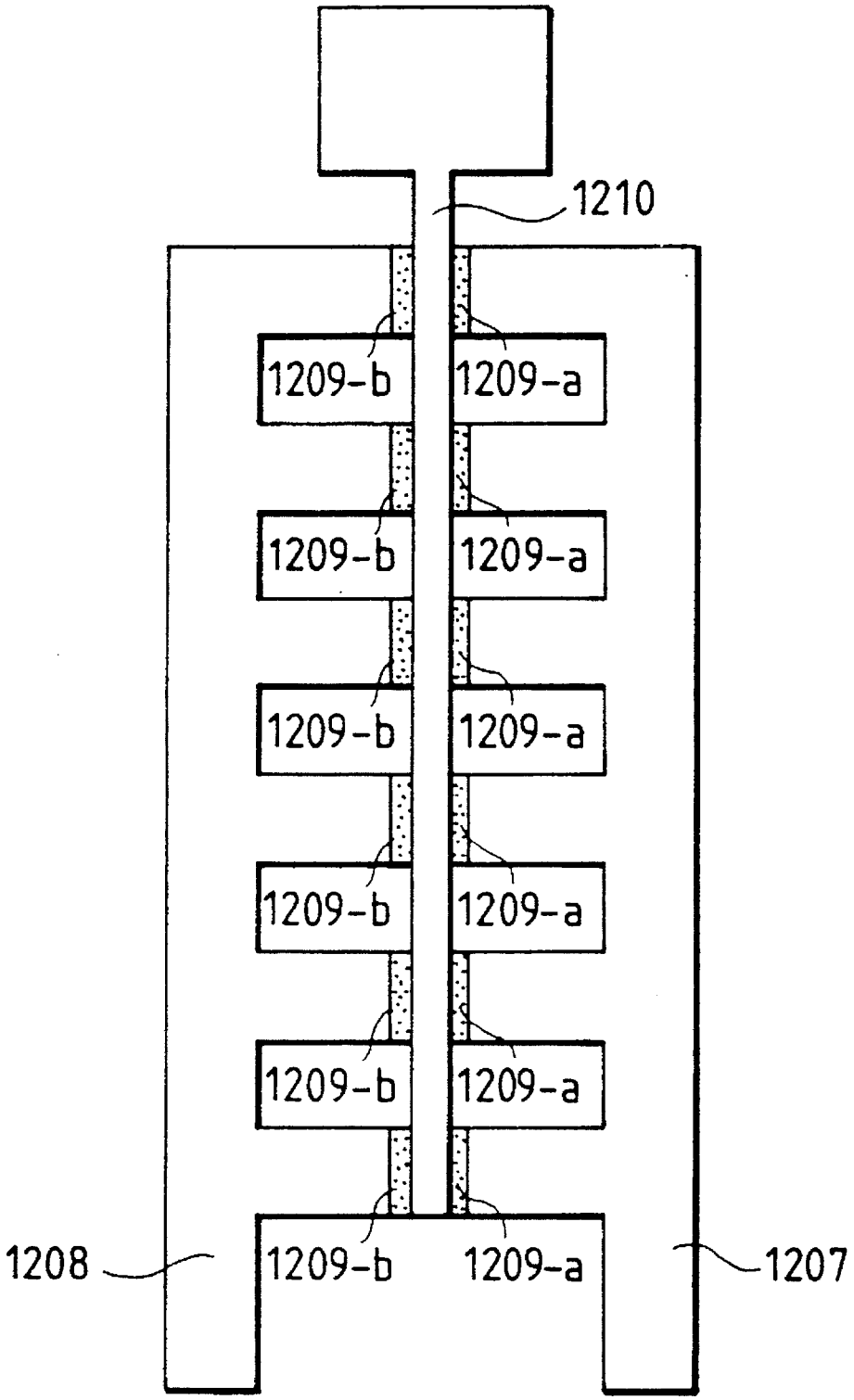
FIG. 11 is a plan view of the surface conduction electron-emitting element of Embodiment 2 of the present invention.

FIG. 11 is a plan view of this type of a surface conduction electron-emitting element. The element comprises element electrodes 1207, 1208, emitting region-generating thin films 1209-*a*, 1209-*b*, and selecting electrode 1210. As is clear from the drawing, six emitting region-generating thin films are provided respectively for the 1209-*a* side and for the 1209-*b* side, namely twelve thin films in total. In the element of this embodiment, the element electrodes, the selecting electrode, and the emitting region-generating thin films are prepared in the same manner as described regarding the element in FIGS. 2(*a*) to 2(*e*). Therefore, the explanation thereof is omitted here.

In this embodiment, the emitting region-generating thin films are divided into two groups of 1209-*a* and 1209-*b*, each group of the thin films is tested for defectiveness and failure. The test may be conducted by the method using an image pick-up apparatus and image processing technique employed in Embodiment 1, or combination thereof with electrical test method. (In particular, an electrical test method is effective in detecting a short-circuit defect.)

Figure 12:
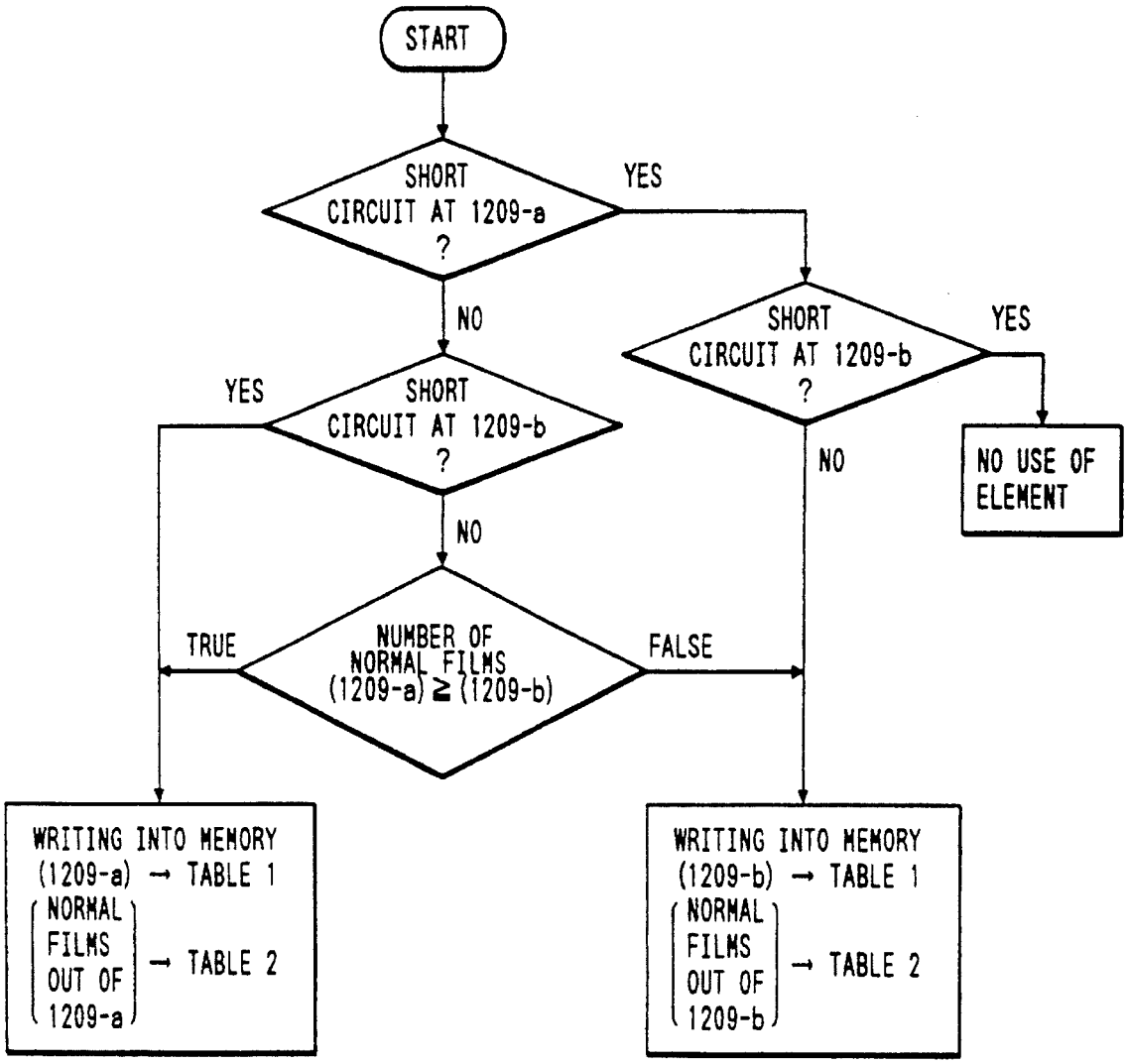
FIG. 12 is a flow chart for explaining algorithm of the method of test of the surface conduction electron-emitting element of Embodiment 2 of the present invention.

In this embodiment, the test is conducted for the above two groups to detect the short-circuit and to count the number of normal emitting region-generating thin films, and the test results are stored in a test result storing memory (not shown in the drawing). In the test result storing memory, at least two tables are provided. In Table 1, the test results are memorized as to which of the two thin film groups should be used, and in Table 2, the number of normal emitting region-generating thin films is memorized. This is practices, for example, following the flow chart as shown in FIG. 12. In principle of evaluation, if even one short-circuit defect is found in a group of the thin films, the group is not used. For example, if even one short-circuit defect is found in the six emitting region-generating thin films of the group 1209-*a*, the group 1209-*a* is not used. Accordingly in an extremely rare case where both two groups of 1209-*a* and 1209-*b* have a short-circuit, the element is not used. In the case where no short-circuit defect is found in both groups, the group is used which has more normal emitting region-generating thin films. In such a manner, it is decided which group should be used, and the group name is written into Table 1 in the test result string memory. At the same time, the number of the normal emitting region-generating thin films in the usable group is written into Table 2 in the test result storing memory. As an example, in the case where the both groups of the thin films have no short-circuit and the group 1209-*a* has four normal emitting region-generating thin films and the group 1209-*b* has five normal emitting region-generating thin films, the group name "1209-*b*" is written into Table 1 and the number of "5" is written in Table 2. Hereinafter in FIGS. 13 and 14, description is made as to this example.

Figure 13:
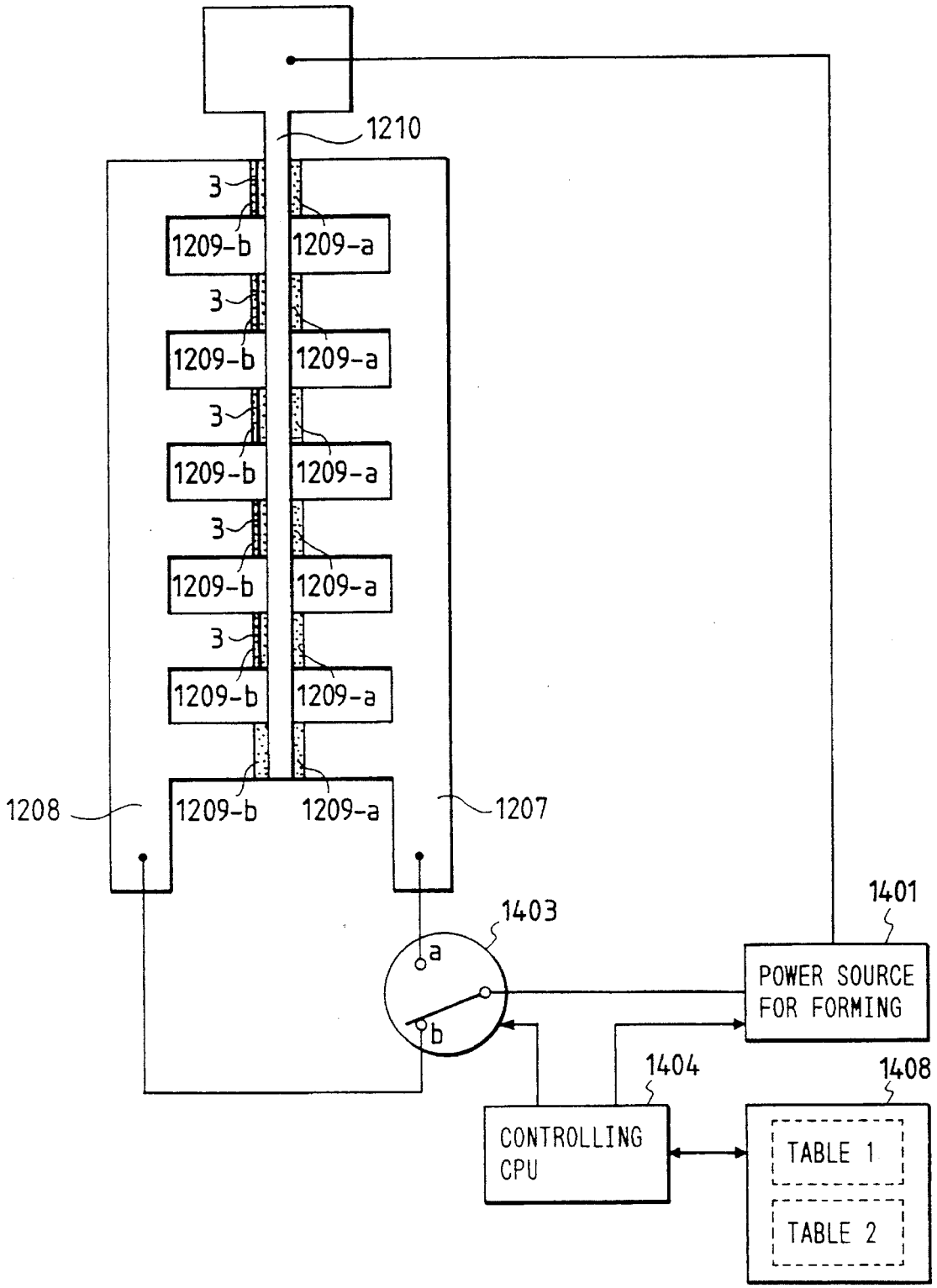
FIG. 13 is a simplified circuit diagram for the process of forming of the surface conduction electron-emitting element of Embodiment 2 of the present invention.

The electrical forming treatment in this Embodiment is described by reference to FIG. 13. In FIG. 13, the numeral 1401 denotes a power source for forming; 1403, a change-over switch; 1408, a test result string memory; and 1404, a controlling CPU for controlling the operation of 1401, 1403, and 1408. The controlling CPU 1404 reads out the group name to be used from Table 1 in the test result storing memory 1408, and sends signals to the change-over switch to connect electrically the group of thin films (1209-*b* in this example) to the power source 1401 for forming, and then sends a control signal to the power source 1401 for forming to output a forming voltage as explained in the case of FIG. 5 to conduct electrical forming treatment. Through the steps described above, satisfactory electron-emitting regions 3 are formed on the normal five of the emitting region-generating thin films 1209-*b*.

Figure 14:
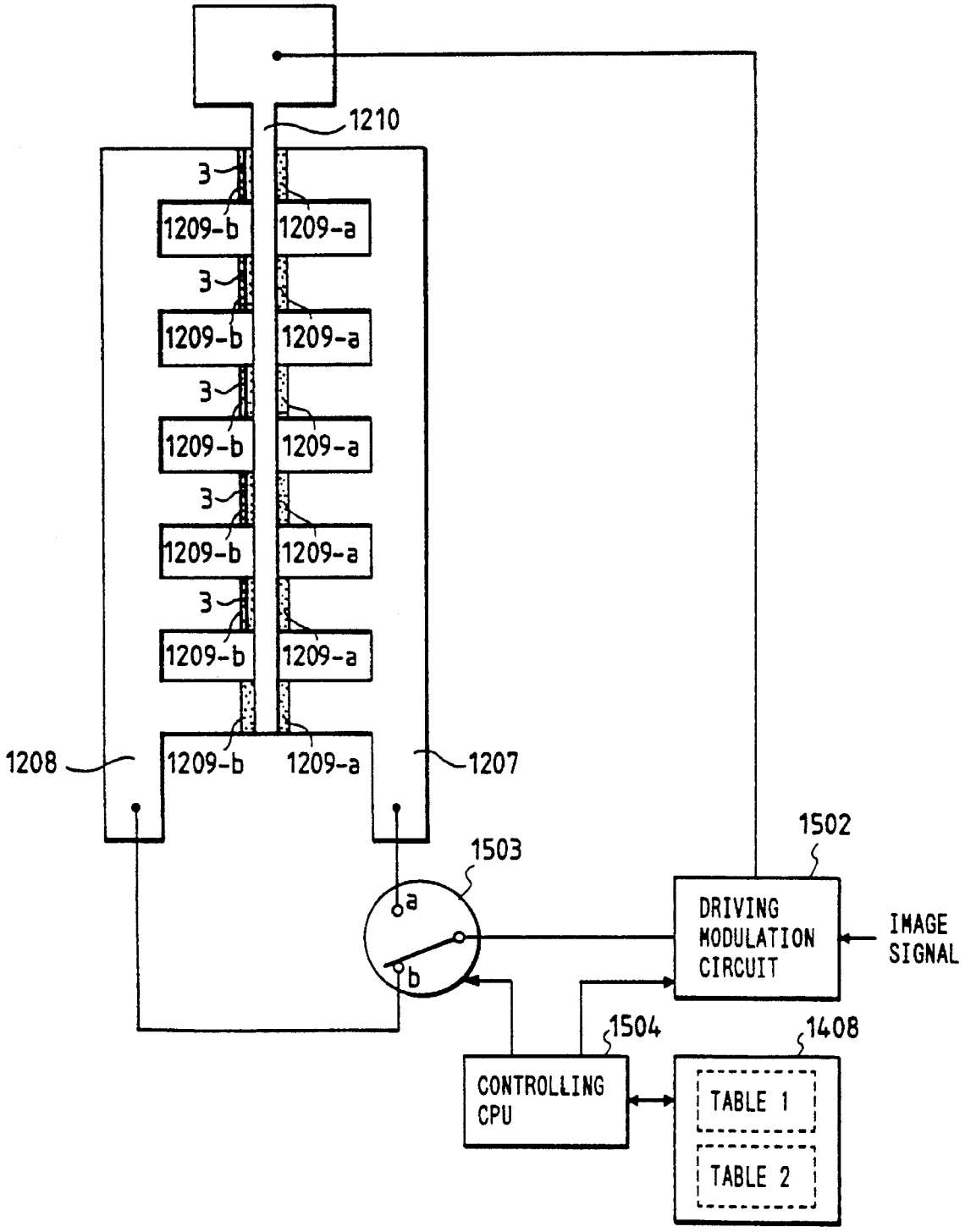
FIG. 14 is a simplified circuit diagram for explaining the method of driving of the display device of Embodiment 2 of the present invention.

The driving method of the element applied to image display unit is described by reference to FIG. 14. In FIG. 14, the numeral 1502 denotes a driving modulation circuit; 1503 a change-over switch; and 1504, a controlling CPU for controlling the display operation.

In this Embodiment, the driving signal, which is corrected corresponding to the number of normally formed electron-emitting regions, is selectively applied to the thin film group having electron-emitting regions 3 formed thereon. The controlling CPU 1504 reads out the group to be driven (1209-*b* in this example), and send a control signal according to the information to the change-over switch, thereby connecting electrically the thin film group to be driven to the driving modulation circuit 1502. Then the controlling CPU 1504 reads out the number of the normally formed electron-emitting regions (five in this example) from Table 2 in the test result storing memory 1408, and sends a correction signal based on the number to the drive modulation circuit 1502. The driving modulation circuit 1502 outputs driving signal, which is corrected by the correction signal from the controlling CPU 1504, to drive the surface conduction electron-emitting element in accordance with the image signal from the outside.

For example, in driving of the surface conduction electron-emitting element by pulse width modulation according to inputted image signals, the pulse width of the output signal is corrected by a factor of 6/5 in this example. This is because five out of six electron-emitting regions are normal, and the intensity of the electron beam output would be 5/6 times the normal intensity without the correction. In the case where the designed number of electron-emitting regions is M and the number of the usable normal ones is N, the intended display luminance can be achieved by driving the element with the pulse width modified by a factor of M/N since the entire quantity of the charge of the electron beam is proportional to the number of electron-emitting regions and the driving pulse width.

In driving the surface conduction electron-emitting element by voltage modulation corresponding to inputted image signal, the modulation voltage is corrected corresponding to the number of the normal electron-emitting regions before applying the driving signal to the element. In this case, the intended luminance cannot be achieved by simply increasing the applied voltage by a factor of 6/5 because the dependence of the output current Ie on the element voltage Vf of the surface conduction electron-emitting element is non-linear as explained by reference to FIG. 7. Therefor the modulation voltage is corrected to give output intensity of one electron-emitting region is 6/5 times an accordance with the non-linear characteristics of the surface conduction electron-emitting element.

In this Embodiment, although 12 emitting region-generating thin film is provided in one element, namely 6 thin films on each side of the selecting electrode 1210, the number of the thin film is naturally not limited thereto.

Embodiment 3

A third embodiment of the present invention is described by reference to FIGS. 15 to 21. This Embodiment is characterized in that a heat-fusible electroconductive member is employed as the means for changing the electric connection.

Figure 15:
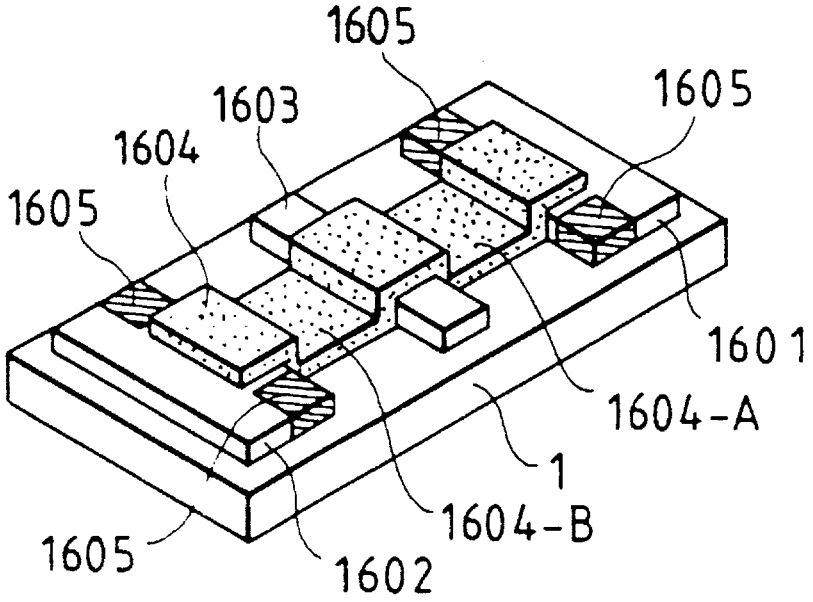
FIG. 15 is a perspective view of the surface conduction electron-emitting element of Embodiment 3 of the present invention before forming treatment.

FIG. 15 illustrates this type of a surface conduction electron-emitting element before electrical forming treatment. The unit comprises a glass substrate 1, element electrodes 1601, 1602, an intermediate electrode 1603, an emitting region-generating thin film 1604, and a heat-fusible electroconductive member 1605. The portions of the emitting region-generating thin film 1604 on the both side of the intermediate electrode are named 1604-A and 1604-B, respectively.

The method of formation of the element unit is described by reference to the side views shown in FIGS. 16A(1) to 16A(3).

Firstly, as shown in FIG. 16A(1), element electrodes 1601, 1602, and an intermediate electrode 1603 are formed on a glass substrate. These electrodes can be formed readily by laminating successively, for example titanium in a thickness of 50 Å and nickel in a thickness of 1000 Å by vacuum deposition, and patterning by photolithographic etching. The distance G between the element electrode and the intermediate electrode, for example, is 2 microns.

Then, as shown in FIG. 16A(2), a heat-fusible electroconductive member 1605 is formed. The member has desirably characteristics that it is relatively readily fusible on heating and has high electro-conductivity. Practically, the heat-fusible member has a melting point lower than the melting points of the construction material such as the glass substrate 1, the electrodes 1601, 1602, and 1603, and the emitting region-generating thin film 1604. In this Embodiment, the heat-fusible electroconductive member 1605 is formed from a soldering material which has a melting point of about 322° C. and composed of Sn (2%) and Pb (98%) by vacuum vapor deposition and photolithographic etching. Indium, for example is also suitable as the material for the heat-fusible member.

Further, the emitting region-generating thin film 1604 is prepared as shown in FIG. 16A(3). This thin film can readily be formed, for example, by forming a mask pattern of chromium thin film of 1000 Å thick, applying an organic palladium solution (CCP 4230, made by Okuno Seiyaku K.K.), baking it, and lifting off the chromium thin film by wet etching with an acidic etchant.

The element shown in FIG. 15 has been prepared as above. In this Embodiment, the emitting region-generating thin films 1604-A and 1604-B are tested for defectiveness or failure as explained by reference to FIGS. 22(1) to 22(6). The test may be conducted with an image pickup apparatus and image processor as described in Embodiment 1, or may be an electric test method as described by reference to FIG. 3. When an electric test method is employed, the electric circuit similar to that shown in FIG. 3 is useful where the intermediate electrode 1603, the element electrode 1601, and the element electrode 1602 correspond respectively to the selecting electrode 10, the element electrode 7, and the element electrode 8.

Based on the result of the aforementioned test, in this Embodiment, the heat-fusible member which is the change-over means for the electric connection is selectively fused by heating. Thereby, an electrically parallel conduction path is formed on an emitting region-generating thin film having defectiveness or failure.

For example, if one of the portions 1604-A and 1604-B of the emitting region-generating thin film has defect or failure, the electroconductive member 1605 on the defective or failed thin film portion side is heated and fused selectively. If, the both portions of the thin film are normal, either one portion side of the electroconductive member 1605 is heated and fuzed, the 1604-B side in this example. Such a substrate is repaired if it is reparable, or is reused as the starting material desirably from the standpoint of material saving.

The aforementioned heating is conducted, for example, by irradiating a laser beam locally onto the electroconductive member to be heated from a laser source 1701 as shown in FIG. 16A(4). Thereby, a portion of the electroconductive member is fused to form an electric path 1700 to connect the element electrode 1602 with the intermediate electrode 1603. The laser beam may be projected directly as shown in FIG. 16A(4), irradiated with interposition of a light-transmissive plate 1702 as shown in 16B(4'), irradiated through the glass substrate from the back side as shown in FIG. 16B(4"), or in any other way, provided that the local heating is practicable. Particularly when the surface conduction electron-emitting element is sealed in a vacuum cell during a production process for use in vacuum, the heating methods of FIGS. 16B(4') and 16B(4") are practically useful. As the laser source, the ones of an infrared zone such as carbon dioxide gas laser, CO laser, and YAG laser are useful. The laser beam is desirably the one which is capable of giving relatively high output power and is matched with the absorption wavelength of the electroconductive member 1605. In the case where the electroconductive member does not have a absorption spectrum at a suitable wavelength zone, the member may be indirectly heated, for example, by forming a black carbon film in adjacent to the electroconductive member, and heating the carbon film by laser light.

After formation of the electroconductive path 1700, as described above, electric forming treatment is conducted as shown in FIG. 16A(5) by applying a forming voltage between the element electrodes 1601 and 1602 by use of a forming power source 1703. The forming voltage may have a waveform, for example, as shown in FIG. 5. In this Embodiment, since the defective or failed emitting region-generating thin film has an electrically parallel electroconductive path 1700 formed as described above, the forming voltage supplied by the forming power source 1703 is effectively applied to the normal emitting region-generating thin films. Thus, the surface conduction electron-emitting element of this Embodiment is prepared.

Figure 18:
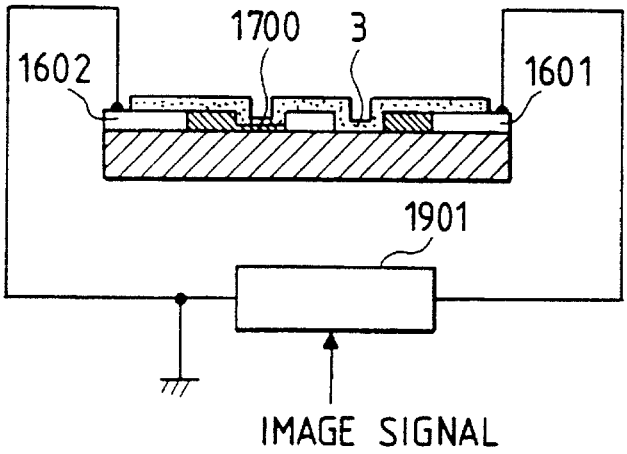
FIG. 18 is a simplified circuit diagram for explaining the method of driving the display device of Embodiment 3 of the present invention.

FIG. 17 is a perspective view of a portion of the display unit employing the aforementioned surface conduction electron-emitting element, showing one unit of the surface conduction electron-emitting element as the electron source and a face plate 11 having a fluorescent material 63 as the image forming member. The face plate 11 is similar to the one described by reference to FIG. 1, therefore the explanation thereof being omitted here. With the display unit of FIG. 17, for image formation in accordance with an image signal from the outside, a driving signal is applied from a driving modulation circuit 1901 as shown in FIG. 18 between the element electrodes 1601 and 1602 of the surface conduction electron-emitting element. (The intermediate electrode 1603 in this Embodiment is not directly connected with an external driving circuit during driving, and is different from the selecting electrode 10 described in Embodiment 1 and Embodiment 2.) The driving modulation circuit 1901 modifies properly the element voltage Vf or the voltage application time for the element in accordance with the image signal from the outside.

Figure 19:
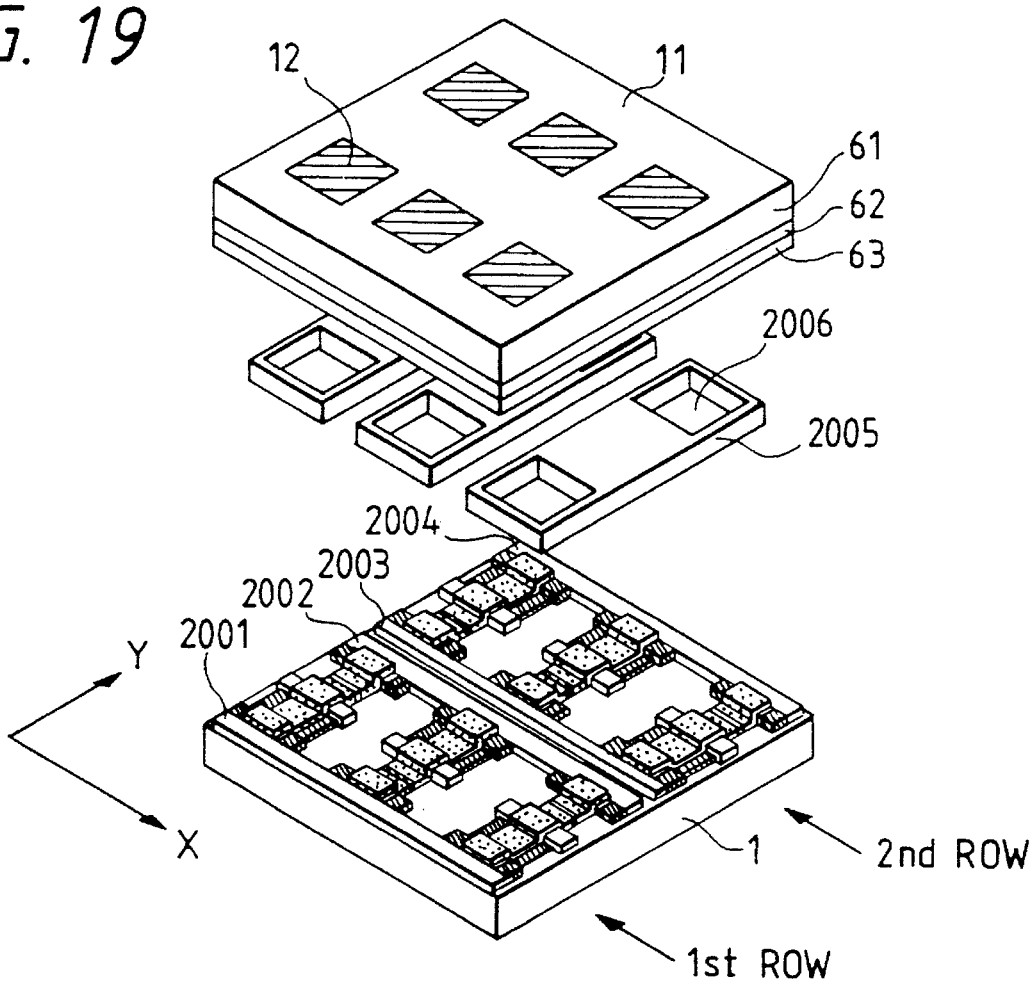
FIG. 19 is a partial perspective view of another type of the display device of Embodiment 3 of the present invention.

FIG. 19 is a perspective view of a part (corresponding to six image element) of another example of a display unit, which has a surface conduction electron-emitting element of this Embodiment having a construction different from the one shown in FIG. 17. In this display device, units of the surface conduction electron-emitting element are formed in parallel lines in the X direction on the glass substrate 1. (In FIG. 19, two lines of 3 units) The units has wiring for each line in parallel. In FIG. 19, a first line of the units has common wiring electrodes 2001, 2002, and a second line of the units has common wiring electrodes 2003, 2004. All the element units have naturally been produced and subjected to the forming treatment in the manner described above in this Embodiment. In FIG. 19, the numeral 11 denotes a face plate of the display device, and the numerals 61, 62, 63, 12, etc. denote the same articles respectively as in FIG. 1. Between the surface conduction electron-emitting element and the face plate, stripe-shaped grid electrodes 2005 are provided. In the drawing, three grid electrodes are shown, each having a through-path 2006 for passing an electron beam emitted from the units of the surface conduction electron-emitting element. The quantity of the passing electron beam emitted form the surface conduction electron-emitting element is controllable by the voltage applied to the grid electrode 2005. Therefore, the luminescence of the fluorescent material 63 can be modulated by applying modification signal to the grid electrode in accordance with the image signal from the outside. This display device has units arranged in lines in the X direction and grid electrodes arranged in the Y direction, in a form of matrix, and the luminance of each of the picture element is controlled by selecting suitable X and Y.

Figure 20:
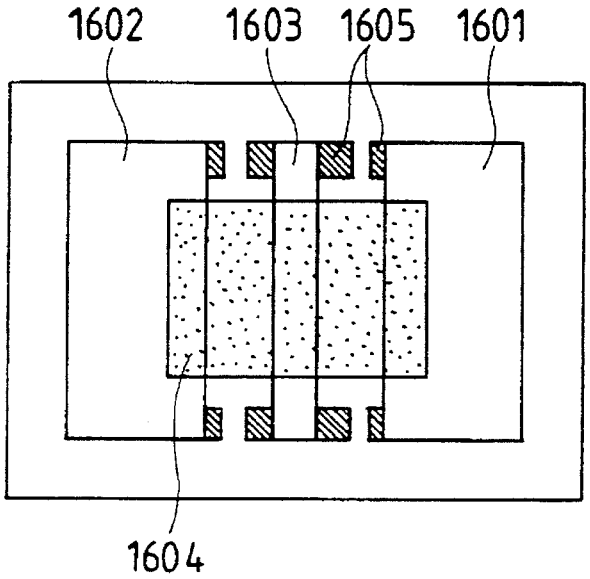
FIG. 20 is a plan view of a second surface conduction electron-emitting element of Embodiment 3 of the present invention.
Figure 21:
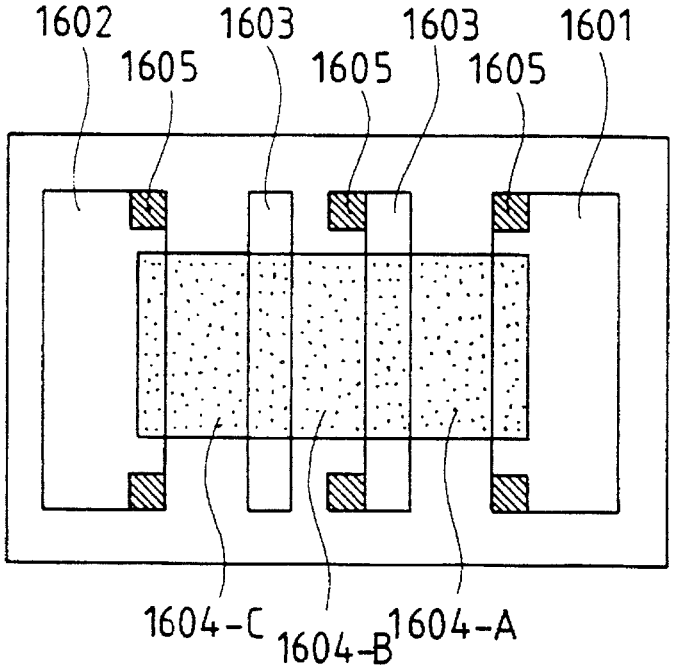
FIG. 21 is a plan view of a third surface conduction electron-emitting element of Embodiment 3 of the present invention.

The surface conduction electron-emitting element of Embodiment 3 is not limited to the one shown in FIG. 15, but may be a planar ones as shown in FIGS. 20 and 21. The heat-fusible electroconductive member 1605 may be provided not only in adjacent to the element electrodes but also in the sides of the intermediate electrode 1603 as shown in FIG. 20 so as to facilitate formation of the electroconductive path. Furthermore, the number of the emitting region-generating thin films is not limited to 2 per element. As shown in FIG. 21, two intermediate electrodes are provided between the element electrodes 1601, 1602, and three emitting region-generating thin films 1604-A, 1604-B, 1604-C may be formed in series electrically.

In the present invention as described above, in production of electron beam-generating device, the electron-emitting region is provided by forming element electrodes and an emitting region-generating thin film on a substrate and subjecting normal thin films of the formed ones selectively to electric forming treatment. On driving the device, driving signals are applied selectively to normal electron-emitting regions. Thereby, a multiple electron source which employs a number of surface conduction electron-emitting elements and image-forming apparatus employing the multiple electron sources are produced at a higher yield. Furthermore, in comparison with the prior art, a larger number of surface conduction electron-emitting elements can be formed and driven without defects, which a larger picture size of display apparatus having a larger number of picture elements than conventional ones can be realized. The image display apparatus having such advantages according to the present invention is applicable in many public and industrial fields not only for high-vision television displays, and computer terminals, but also a large-picture home theaters, TV conference systems, TV telephones, and do forth.

What is claimed is:

1. A process for producing an electron source having a substrate, and an electron-emitting element provided on the substrate: said process comprising steps of forming a plurality of electrode pairs on the substrate, forming a thin film for generating an electron-emitting region between each of the electrode pairs, testing for detecting a defect of the electrode pairs and/or the thin film, and generating the electron-emitting region so as to have no defect after the step of detecting a defect.

2. The process for producing an electron source according to claim 1, wherein the step for generating the electron-emitting region comprises an electric treatment of flowing current through the thin film for electron-emitting region generation.

3. The process for producing an electron source according to claim 1, wherein the step for generating the electron-emitting region comprises storing the result of the testing step to a memory means, and treating by flowing electric current selectively through the thin film to generate the electron-emitting region so as to have no defect in accordance with the result stored in the memory means.

4. A process for producing an image-forming apparatus comprising an electron source, an image-forming member for forming an image by irradiation of an electron beam emitted from the electron source, and a modulation means for modulating the electron beam irradiated to the image-forming member corresponding to an inputted image signal, wherein the electron source is produced according to the process of any of claims 1 to 3.

5. A process for producing an electron source having a substrate, and an electron-emitting element provided on the substrate: said process comprising steps of forming a plurality of electrode pairs on the substrate, forming a thin film for electron-emitting region generation between each of the electrode pairs, providing an electroconductive member in the vicinity of the emitting region-generating thin film, testing for detecting a defect of the electrode pairs and/or the thin film, forming a conductive path with the electroconductive member between the electrode pair in the vicinity of any defects of the thin film by heat-fusion of the electroconductive member, and generating the electron-emitting region so as to have no defect after the step of detecting a defect.

6. The process for producing an electron source according to claim 5, wherein the step for generating the electron-emitting region comprises an electric treatment of flowing current through the thin film for electron-emitting region generation.

7. The process for producing an electron source according to claim 5, wherein the heat-fusion is conducted by irradiation of laser light onto the electroconductive member.

8. A process for producing an image-forming apparatus comprising an electron source, an image-forming member for forming an image by irradiation of an electron beam emitted from the electron source, and a modulation means for modulating the electron beam irradiated to the image-forming member corresponding to an inputted image signal, wherein the electron source is produced according to the process of any of claims 5 to 7.

* * * * *

UNITED STATES PATENT AND TRADEMARK OFFICE

CERTIFICATE OF CORRECTION

PATENT NO. : 5,605,483

DATED : February 25, 1997

INVENTOR(S) : TOSHIHIKO TAKEDA, ET AL.

It is certified that error appears in the above-identified patent and that said Letters Patent is hereby corrected as shown below:

COLUMN 3

Line 67, "an" should read --a--.

COLUMN 6

Line 10, "Generating" should read --generating--.
Line 19, "region-Generating" should read --region-generating--.
Line 20, "of.defec" should read --of defec- --.
Line 24, "region-Generating" should read --region-generating--.
Line 26, "Generating" should read --generating--.
Line 27, "region-Generating" should read --region-generating--.
Line 37, "films" should read --films are provided--.

COLUMN 7

Line 40, "$LAB_6$," should read --$LaB_6$,--.
Line 57, "7,8," should read --7, 8,--.

COLUMN 9

Line 48, "send" should read --sends--.

UNITED STATES PATENT AND TRADEMARK OFFICE

CERTIFICATE OF CORRECTION

PATENT NO. : 5,605,483

DATED : February 25, 1997

INVENTOR(S) : TOSHIHIKO TAKEDA, ET AL.

It is certified that error appears in the above-identified patent and that said Letters Patent is hereby corrected as shown below:

COLUMN 10

Line 3, "varies" should read --varied--.
Line 34, "send" should read --sends--.
Line 63, "films" should read --film--.

COLUMN 11

Line 9, "Naturally" should read --Naturally,--.

COLUMN 12

Line 26, "ground" should read --ground--.
Line 33, "form" should read --from--.

COLUMN 13

Line 54, "out" should read --out- --.

COLUMN 14

Line 40, "practices" should read --practiced--.
Line 46, "Accordingly" should read --Accordingly,--.

UNITED STATES PATENT AND TRADEMARK OFFICE

CERTIFICATE OF CORRECTION

PATENT NO. : 5,605,483

DATED : February 25, 1997

INVENTOR(S) : TOSHIHIKO TAKEDA, ET AL.

It is certified that error appears in the above-identified patent and that said Letters Patent is hereby corrected as shown below:

COLUMN 16

Line 27, "ably" should read --able--.

COLUMN 17

Line 28, "a" should read --an--.

COLUMN 18

Line 5, "units)" should read --units.)-- and "has" should read --have--.
Line 20, "form" should read --from--.
Line 63, "do" should read --so--.

Signed and Sealed this

Ninth Day of September, 1997

*Attest:*

BRUCE LEHMAN

*Attesting Officer*

*Commissioner of Patents and Trademarks*